US006763205B2

(12) United States Patent
Izawa et al.

(10) Patent No.: US 6,763,205 B2
(45) Date of Patent: Jul. 13, 2004

(54) IMAGE HEATING APPARATUS WITH HEATER IN FORM OF A PLATE COOPERABLE WITH A ROTATABLE MEMBER TO FORM A HEATING NIP

(75) Inventors: Satoru Izawa, Shizuoka-ken (JP); Masahiro Goto, Mishima (JP); Toshio Miyamoto, Numazu (JP); Masahiko Suzumi, Numazu (JP); Eiji Uekawa, Shizuoka-ken (JP); Koji Nihonyanagi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/263,962

(22) Filed: Oct. 4, 2002

(65) Prior Publication Data

US 2003/0118363 A1 Jun. 26, 2003

(30) Foreign Application Priority Data

Oct. 9, 2001 (JP) ..... 2001/311554
Sep. 25, 2002 (JP) ..... 2002/279075

(51) Int. Cl.[7] ..... G03G 15/20

(52) U.S. Cl. ..... 399/69; 399/328; 399/330; 399/331; 219/216

(58) Field of Search ..... 219/216; 399/67, 399/69, 320, 328, 330, 331, 333, 335, 336, 337

(56) References Cited

U.S. PATENT DOCUMENTS

| | | | | |
|---|---|---|---|---|
| 4,071,735 A | * | 1/1978 | Moser | 219/216 |
| 4,883,715 A | | 11/1989 | Kuge et al. | 428/421 |
| 4,970,219 A | | 11/1990 | Effland et al. | 514/339 |
| 5,149,941 A | | 9/1992 | Hirabayashi et al. | 219/216 |
| 5,153,660 A | | 10/1992 | Goto | |
| 5,210,579 A | | 5/1993 | Setoriyama et al. | |
| 5,253,024 A | | 10/1993 | Okuda et al. | |
| 5,264,902 A | | 11/1993 | Suwa et al. | |
| 5,280,328 A | | 1/1994 | Goto et al. | |
| 5,285,245 A | | 2/1994 | Goto et al. | |
| 5,289,247 A | | 2/1994 | Takano et al. | |
| 5,293,202 A | | 3/1994 | Adachi et al. | |
| 5,420,679 A | | 5/1995 | Goto et al. | |
| 5,450,181 A | | 9/1995 | Tsukida et al. | |
| 5,525,775 A | | 6/1996 | Setoriyama et al. | 219/216 |
| 5,572,306 A | | 11/1996 | Goto et al. | 399/69 |
| 5,722,026 A | | 2/1998 | Goto et al. | 399/333 |
| 5,860,051 A | | 1/1999 | Goto et al. | 399/529 |
| 5,862,435 A | | 1/1999 | Suzumi et al. | 399/68 |
| 5,920,757 A | | 7/1999 | Izawa et al. | 399/329 |
| 6,085,058 A | | 7/2000 | Goto et al. | 399/313 |
| 6,115,563 A | | 9/2000 | Miyamoto | 399/67 |
| 6,185,383 B1 | | 2/2001 | Kanari et al. | 399/45 |
| 6,298,213 B1 | | 10/2001 | Miyamoto et al. | 399/320 |
| 6,336,009 B1 | | 1/2002 | Suzumi et al. | 399/67 |

FOREIGN PATENT DOCUMENTS

| | | |
|---|---|---|
| JP | 63-313182 | 12/1988 |
| JP | 02-157878 | 6/1990 |
| JP | 4-44075 | 2/1992 |
| JP | 4-204980 | 7/1992 |
| JP | 8-129313 | 5/1996 |
| JP | 10-69176 | 3/1998 |
| JP | 10-301417 | 11/1998 |
| JP | 11-73050 | 3/1999 |
| JP | 2000-19876 | 1/2000 |

* cited by examiner

*Primary Examiner*—Hoang Ngo
(74) *Attorney, Agent, or Firm*—Fitzpatrick, Cella, Harper & Scinto

(57) ABSTRACT

An image heating apparatus includes a rotatable member; back-up means for cooperating with the rotatable member to form a feeding nip for feeding a recording material; heating means for heating an outer peripheral surface of the rotatable member, the heating means including a heater in the form of a plate cooperable with the rotatable member to form a heating nip.

22 Claims, 12 Drawing Sheets

FIXING RLR IO SIDE

IMAGE HEATING APPARATUS WITH HEATER IN FORM OF A PLATE COOPERABLE WITH A ROTATABLE MEMBER TO FORM A HEATING NIP

FIELD OF THE INVENTION AND RELATED ART

The present invention relates to an image heating apparatus for heating the image on recording medium. In particular, it relates to an image heating apparatus effective as a fixing apparatus mounted in a copying machine, printer, etc.

Heretofore, as a fixing apparatus employed by an image forming apparatus employing an electrophotographic method, an electrostatic recording method, or the like, a so-called thermal fixing apparatus has been widely used, which comprises a fixing roller and a pressure roller, and which passes the recording medium bearing an unfixed toner image, through the nipping portion formed by the fixing roller and pressing roller, in order to fix the unfixed toner image on the recording medium to the recording medium to effect a permanent toner image.

FIG. 10 is a schematic view of a typical thermal fixing apparatus which employs a heat roller. The fixing roller 40 comprises: a hollow metallic core 42 formed of aluminum, stainless steel, or the like; a heating member 41, such as a halogen lamp, disposed within the hollow of the metallic core 42; and a release layer 43 formed of fluorinated resin, or the like, on the peripheral surface of the metallic core 42 to prevent toner offset. The surface temperature of the fixing roller is detected using a temperature detecting means such as a thermistor, and the power supply to the heating member 41 is controlled by an unshown power supply control circuit, so that the surface temperature of the fixing roller detected by the temperature detecting means 44 remain constant.

A pressure roller 50 comprises a metallic core 51, an elastic layer 52 formed on the peripheral surface of the metallic core 51, and a release layer 53 formed on the peripheral surface of the elastic layer 52. The elastic layer 52 is formed of silicon rubber, sponge formed by foaming silicon rubber, or the like. The release layer 53 is formed of fluorinated resin, or the like, as is the release layer of the fixing roller 40.

The fixing roller 40 and pressure roller 50 are kept pressed upon each other, with the application of a predetermined amount of pressure, so that a nipping portion is formed as a fixing nip N. The two rollers 40 and 50 are rotationally driven so that their peripheral surfaces are moved in the direction indicated by the arrow marks in the drawing. In operation, a recording medium P bearing an unfixed toner image is introduced into the fixing nip N, and is passed through the fixing nip N, remaining nipped by the two rollers 40 and 50. While the recording is passed through the fixing nip N, the unfixed toner image on the recording medium P is permanently fixed to the recording medium P by heat and pressure.

In some of high speed image forming apparatuses, and some of image forming apparatuses which use color toners, an approximately 2 mm thick elastic layer formed of silicon rubber or the like is provided between the hollow metallic core 42 and release layer 43 of the fixing roller 40 of the fixing roller 40, in order to satisfactorily fix the toner, more specifically, in order to prevent the unfixed toner image from being nonuniformly fixed. The provision of this elastic layer softens the peripheral surface of the fixing roller 40.

Therefore, as the recording medium P is nipped by the two rollers 40 and 50, the softened peripheral surface of the fixing roller 40 presses the recording medium and the toner particles in the toner image, in a manner to embrace the toner particles on the recording medium P, improving the efficiency with which heat is transmitted from the fixing roller 40 to the recording medium and toner particles thereon.

In recent years, there has been a strong desire for reducing electrical power consumption because of the environmental concern. On the other hand, the market has been demanding higher image quality and higher image output. Thus, in order to meet both the desire for the reduction in electrical power consumption and the market demand for higher speed and higher image quality, various proposals have been made to improve the above described thermal fixing apparatus employing a heat roller.

Referring to FIG. 11, one of the such proposals is disclosed, being realized in the form of a thermal heating apparatus low in power consumption and superior in thermal efficiency, in Japanese Laid-open Patent Applications, 10-301417, 11-073050, etc., according to which in order to reduce the electrical power consumption by reducing the time it takes for the fixing roller 40 to reach the operational temperature, heating rollers 47 and 55 containing the heating members 46 and 54 are placed in contact with the peripheral surfaces of the fixing roller 40 and pressure roller 50, respectively, to heat the peripheral surfaces thereof.

The heating members for heating the peripheral surface of the fixing roller 40 or pressure roller 50 can be divided into two types: a type which is kept in contact with the peripheral surface of the fixing roller 40 or pressure roller 50; and a type which is not placed in contact therewith. The contact type is higher in heat transmission efficiency. Further, in terms of another heating roller property different from the preceding ones, the heating rollers can also be divided into two types: a type which contains the heating members 46 and 54, as shown in FIG. 11, and a type, in which the internal surface of its hollow metallic core is coated with a heat generating resistive layer, that is, an electrically resistive layer which generates heat as electrical current is flowed through it, with the interposition of an electrically insulative layer formed of organic resin (polyimide, for example), glass, or the like material.

As an example of the latter type, a thermal fixing method of a film heating type is proposed in Japanese Laid-Open Patent Applications 63-313182, 2-157878, 4-44075, 4-204980, etc. According to this thermal fixing method, a toner image on recording medium is fixed through a piece of film which is thin and low in thermal capacity, and which is placed between the heating portion and pressure roller, and power consumption is minimized by not supplying power to the thermal fixing apparatus while an image forming apparatus is on standby. FIG. 12 shows the general structure of an example of a film heating type fixing apparatus. In the drawing, a referential code 60 stands for a film assembly, which comprises: a heater 61 comprising a plate of ceramic, such as alumina, aluminum nitrate, etc., and a heat generating resistive layer formed on the ceramic plate; a stay/holder 62 which is formed of heat resistant resin, and to which the heater 62 is solidly fixed; a heat resistant thin film 63 (which hereinafter will be referred to as fixing film) which is formed of polyimide, or the like, and which is loosely fitted around the stay/holder 62. The heater 61 of this film assembly 60, and the pressure roller 50, are kept pressed against each other, with the interposition of the fixing film 63, forming the fixing nip N.

As the pressure roller 50 is rotationally driven in the direction indicated by an arrow mark, the fixing film 63 is conveyed by the rotation of the pressure roller 50 in the direction indicated by another arrow mark, through the fixing nip N, while being kept in contact with the heating roller 61 (sliding on the heating roller 61). The temperature of the heater 61 is detected by a temperature detecting means 64, such as a thermistor, disposed on the back surface of the heater, and is fed back to an unshown power supply control portion so that the temperature of the heater 61 is kept at a predetermined level (fixing temperature).

Compared to image forming apparatuses, such as printers, copying machines, etc., employing a thermal heating apparatus in accordance with the prior art, which employs a thermal roller, the image forming apparatuses employing a thermal fixing apparatus of a film heating type such as the above described one enjoy various advantages in that they are higher in heating efficiency and shorter in startup time, making it unnecessary for the heating apparatus to be kept warm (preheated) during a standby period, and also, shortening the wait time.

However, the above described thermal fixing apparatuses of various types all have their merits and demerits. For example, in the comparison between a thermal fixing apparatus of a heat roller type and a thermal fixing apparatus of a film heating type, the former is superior to the latter in process speed, durability, etc.

In order for a thermal fixing apparatus to be preferably employed by a high speed image forming apparatus, even a thermal fixing apparatus employing a heat roller must have an elastic layer. However, a conventional thermal fixing apparatus employing a heat roller is larger in the thermal capacity of its fixing roller. Therefore, the time it takes for the surface temperature of the fixing roller to be raised to a predetermined level by the heat transferred from within the fixing roller through the elastic layer, which is inferior in thermal conductance, is overwhelmingly long, compared to the thermal heating apparatuses employing a film heating type fixing method. Further, a conventional thermal fixing apparatus employing a heat roller is greater in the amount of the electrical power it requires to raise the temperature of the fixing roller to a predetermined level, and is greater in the wait time, that is, the length of the time from when the electrical power source of an image forming apparatus is turned on to when the image forming apparatus becomes ready for an actual printing operation. Also, it requires that the temperature of its fixing roller is kept warm even during a standby period. Therefore, they consume a greater amount of electrical power.

In comparison, in the case of a thermal fixing apparatus in which the peripheral surfaces of the fixing roller and pressure roller are heated from outside, as shown in FIG. 11, by heating members (heat rollers) which are relatively small in thermal capacity, it is unnecessary to heat the interior of the fixing roller having a large thermal capacity; only the peripheral surface portion of the fixing roller must be heated. Therefore, it takes less time and a smaller amount of electrical power for the surface temperature of the fixing roller to be readied to the predetermined level. However, even this type of thermal fixing apparatus is far inferior to a thermal fixing apparatus employing a film heating type fixing method, because in the case of the former, which is structured so that its heating means, such as a halogen heater, is disposed within its hollow metallic core as shown in the drawing, the interior of the heat roller itself must be heated before the peripheral surface of the fixing roller begins to be heat, and therefore, it take a longer time for the peripheral surface of the fixing roller to be raised to the predetermined level.

Further, a thermal fixing apparatus employing a heat roller structured so that a heat generating resistive layer is disposed on the electrically insulative layer coated on the internal surface of the heat roller, starts up faster than the aforementioned thermal fixing apparatus, the temperature of which is raised by a halogen heater. However, in the case of a thermal fixing apparatus employing this type of heat roller (heating member), the area in which the peripheral surface of the fixing roller can be supplied with heat is only the heating nip formed as the fixing roller and pressure roller are kept pressed upon each other. In other words, in the areas other than the heating nip in which the heat roller is virtually in contact with the peripheral surface of the fixing roller, a substantial amount of the heat from the heat roller radiates into the ambient air, reducing the efficiency with which the heat is supplied to the peripheral surface of the fixing roller. In addition, the fixing roller of this type is also larger in thermal capacity, compared to a fixing roller of a film heating type. Therefore, the fixing roller of this type must also be supplied with a certain amount of heat during a standby period.

In an image forming apparatus in which recording medium is conveyed at a slow speed, the amount of the heat to be supplied to the fixing roller does not need to be as large as the amount of the heat to be supplied to the fixing roller in an image forming apparatus in which recording medium is conveyed at a higher speed. Therefore, in the case of the former image forming apparatus, even a heater roller is satisfactory as a heating means. However, in the case of the latter image forming apparatus, that is, the apparatus in which recording medium is conveyed at a higher speed, it is impossible for the heat roller to supply the fixing roller with a sufficient amount of heat, because of heat loss, that is, because a substantial amount of the heat from the heat roller radiates into the ambient air from the area of the peripheral surface of the heat roller other than that in the heating nip.

Because of the above described reasons, such a thermal fixing apparatus that does not consume electrical power during a standby period, is substantially shorter in the length of time from the reception of a print signal to when the fixing apparatus becomes ready for thermally fixing an unfixed toner image on recording medium to the recording medium (which hereinafter may be referred to as first print time) than a thermal fixing apparatus in accordance with the prior art, and is capable of allowing an image forming apparatus to operate at a higher speed while satisfactorily fixing images inclusive of halftone images, has not been realized, and the development of such a thermal fixing apparatus has long been desired.

SUMMARY OF THE INVENTION

The present invention was made in consideration of the above described problems, and its primary object is to provide an image heating apparatus which is suitable for an image forming apparatus high in the output per unit of time in terms of the copy count, and yet, is low in electrical power consumption.

Another object of the present invention is to provide an image heating apparatus which is suitable for an image forming apparatus higher in the output per unit of time in terms of copy count, and yet, is shorter in the first print time.

Another object of the present invention is to provide an image heating apparatus comprising: a rotational member; backing means for forming, in combination with said rotational member, a conveying nip through which recording medium is conveyed; and heating means for heating the peripheral surface of said rotational member, said heating means having a heater, in the form of a plate, for forming, in combination with said rotational member, a heating nip.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

[Embodiment 1]

(1) Image Forming Apparatus Example

Figure 1:
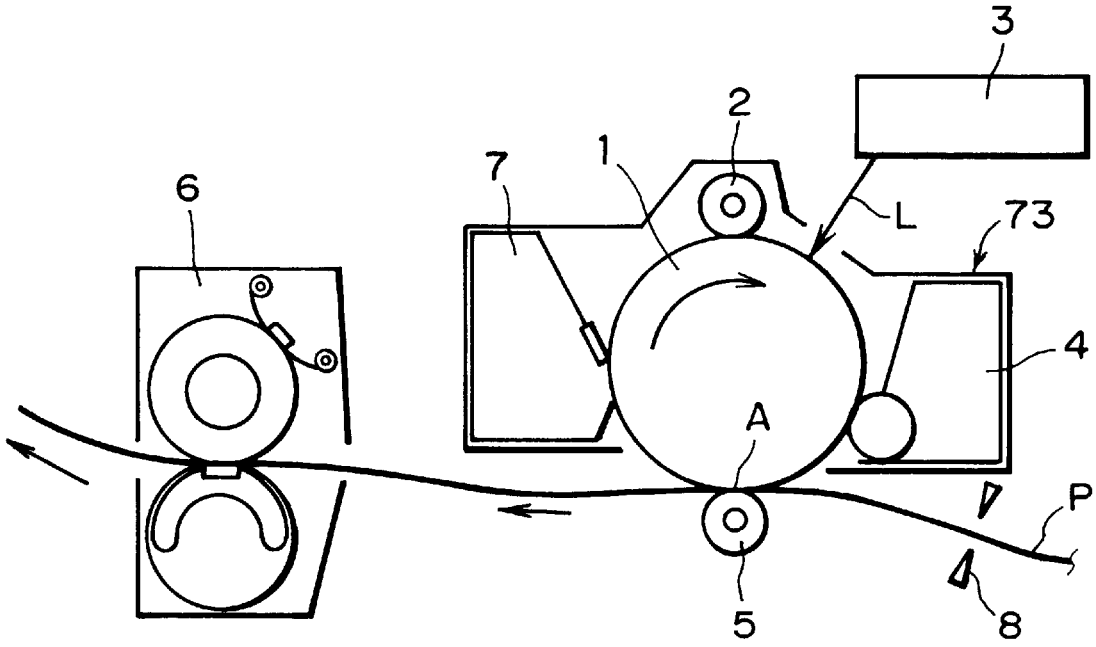
FIG. 1 is a rough sectional view of an example of an image forming apparatus comprising an image heating apparatus in accordance with the present invention.

FIG. 1 is a schematic view of a typical image forming apparatus, for showing the structure thereof. This example of an image forming apparatus is a laser beam printer employing an electrophotographic process of a transfer type.

A referential code 1 stands for an electrophotographic photoconductive member, as an image bearing member, in the form of a rotational drum (which hereinafter will be referred to as photoconductive drum). It comprises a cylindrical substrate formed of aluminum, nickel, or the like, and a layer of photoconductive substance, such as OPC, amorphous silicon, etc., coated on the peripheral surface of the cylindrical substrate.

The photoconductive drum 1 is rotationally driven in the clockwise direction indicated by an arrow mark, at a predetermined peripheral velocity, and as it is rotationally driven, its peripheral surface is uniformly charged to predetermined polarity and potential level by a charge roller 2 as a charging apparatus.

Next, the charged peripheral surface of the photoconductive drum 1 is exposed by a laser scanner 3; image formation information is written on the charged peripheral surface of the photoconductive drum 1 by a laser scanner 3. More specifically, the uniformly charged peripheral surface of the photoconductive drum 1 is scanned by a beam of laser light emitted from the laser scanner 3 while being turned on and off (modulated) in response to sequential digital image signals reflecting the image formation information. As a result, the exposed points of the uniformly charged peripheral surface of the photoconductive drum 1 attenuate in potential level, effecting an electrostatic latent image in accordance with the image formation information, on the peripheral surface of the photoconductive drum 1.

This electrostatic latent image is developed (visualized) as a toner image by a developing apparatus 4. As for the developing method, the jumping developing method, two-component developing method, FEED, etc., are available. Usually, the above described image exposure process is used in combination with the reversal development process.

Then, the toner image is transferred, in a transfer nip A, which is the area in which the transfer roller 5 as a contact transferring apparatus is kept pressed upon the peripheral surface of the photoconductive drum 1, from the peripheral surface of the photoconductive drum 1 onto the surface of a recording medium P delivered to the transfer nip A from the unshown sheet feeding mechanism, with a predetermined timing.

More specifically, the timing of the arrival of the leading edge of the toner image on the photoconductive drum 1 at the transfer nip A is synchronized with the timing of the arrival of the leading edge of the area of the recording medium P, onto which the toner image is to be transferred, by detecting the leading edge of the recording medium P with the use of a sensor 8. After being conveyed to the transfer nip A with the predetermined timing, the recording medium P is conveyed through the transfer nip A by the combination of the photoconductive drum 1 and transfer roller 5, while remaining nipped by the photoconductive drum 1 and transfer roller 5 which apply a predetermined amount of pressure upon the recording medium P. While the recording medium P is conveyed through the transfer nip A, the toner image on the peripheral surface of the photoconductive drum 1 is transferred onto the recording medium P by the electrical force and the pressure.

After being passed through the transfer nip A, the recording medium P is separated from the peripheral surface of the rotating photoconductive drum 1, and is conveyed to a thermal fixing apparatus 6. In the thermal fixing apparatus 6, the unfixed toner image on the recording medium P is thermally fixed to the surface of the recording medium P, becoming a permanent image. After the fixation of the unfixed toner image to the recording medium P, the recording medium P is conveyed to a sheet discharging portion.

Meanwhile, the residual toner particles, that is, the toner particles remaining on the peripheral surface of the photoconductive drum 1 after the separation of the recording medium P, are removed from the peripheral surface of the photoconductive drum 1 by a cleaning apparatus 7. Then, the cleaned area of the peripheral surface of the photoconductive drum 1 is used again for image formation.

A referential code 73 stands for a process cartridge removably (exchangeably) mountable in the main assembly of an image forming apparatus. In this embodiment, four processing devices, that is, the photoconductive drum 1, charge roller 2, developing apparatus 4, and cleaning apparatus 7, are integrally disposed in a cartridge, making up the process cartridge 73 removably (exchangeably) mountable in the image forming apparatus main assembly.

(2) Thermal Fixing Apparatus 6

Figure 2:
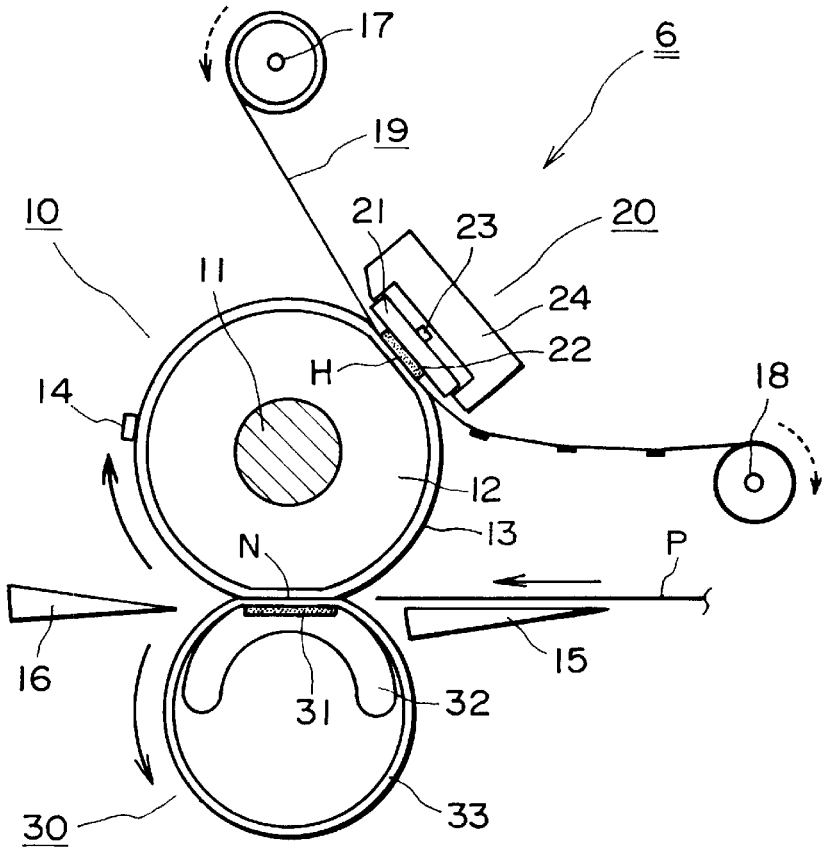
FIG. 2 is a sectional view of the image heating apparatus in the first embodiment of the present invention.

FIG. 2 is an enlarged schematic view of the thermal fixing apparatus 6 in this embodiment. Roughly speaking, this thermal fixing apparatus 6 comprises: a fixing roller 10 (rotational member) having an elastic layer; a heating member 20 which forms a heating nip H by being pressed against the fixing roller 10 with the interposition of a heat resistant sheet 19, and which raises the temperature of the peripheral portion of the fixing roller 10 through the heat resistant sheet 19; and a pressing member 30 (backing means) which forms a fixing nip (conveying nip) N by being kept pressed against the fixing roller 10.

Incidentally, throughout the embodiments of the present invention described in detail in this specification, members which are the same in function are given the same referential codes.

The heating member 20 comprises: a heater (heating member) 21, 22; and a thermally nonconductive stay/holder 24 by which the heater 21, 22 is firmly held. Being firmly held by the stay/holder 24, the heater 21, 22 is disposed in a predetermined position, with respect to the fixing roller 10, so that it is pressed against the peripheral surface of the fixing roller 10 with the interposition of the heat resistant sheet 19, forming the heating nip H.

1) Fixing Roller 10

The fixing roller 10 comprises the following members: a metallic core 11, which is formed of aluminum or iron, and the peripheral surface of which has been roughened by blasting or the like treatment; and an elastic layer 12 formed on the peripheral surface of the roughened peripheral surface of the metallic core 11. The elastic layer 12 is a solid rubber layer formed of silicon rubber, a sponge rubber layer formed of a foamed material produced by foaming silicon rubber in order to enhance the effectiveness of silicon rubber as a thermally insulative material, or a porous layer formed of a material produced dispersing hollow filler particles in silicon rubber in order to enhance the effectiveness of silicon rubber as a thermally insulative material by dispersing air bubbles in silicon rubber, that is, a solid substance.

The fixing roller 10 is relatively large in thermal capacity. Therefore, if it is large in thermal conductance, the heat which the fixing roller 10 receives from the external heating member 20 through its peripheral surface is easily transferred inward thereof, making it difficult for the surface temperature of the fixing roller 10 to rise. Thus, using such a material that is as small as possible in thermal capacity and thermal conductivity, and as thermally insulative as possible is advantageous in terms of the startup time of the fixing roller 10.

The thermal conductivity of the elastic layer formed of solid silicon rubber is in a range of 0.25–0.29 W/(m.k), and the thermal conductivity of the elastic layer formed of silicon rubber sponge, or silicon rubber having air bubbles, is in the range of 0.11–0.16 W/(m.k), which is half the thermal conductivity of the elastic layer of solid silicon rubber.

In relative density (specific gravity), which is related to thermal capacity, solid silicon rubber is approximately in the range of 1.05–1.30, whereas silicon rubber sponge or silicon rubber having air bubbles is approximately in the range of 0.75–0.85.

Thus, the elastic layer 12 of the fixing roller 10 is desired to be formed of rubber sponge, or rubber having air bubbles, which is no more than 0.15 W/(m.k) in thermal conductivity, and no more than 0.85 in relative density.

Further, the smaller the external diameter of the fixing roller 10, the smaller the thermal capacity of the fixing roller 10. However, if the external diameter of the fixing roller 10 is excessively small, it is rather difficult to make the heating nip H and fixing nip N wide enough for satisfactory image fixation. Therefore, the external diameter of the fixing roller 10 should be in a proper range.

If the elastic layer 12 is two thin, too much heat escapes into the metallic core 11. Therefore, the thickness of the elastic layer 12 must be in a proper range.

In this embodiment, in consideration of the above described concerns, a fixing roller which comprises a 4 mm thick elastic layer formed of the rubber having air bubbles, and is 20 mm in external diameter is employed as the fixing roller 10 which is capable of forming a proper heating nip H, and yet, is satisfactorily low in thermal capacity.

As the hollow filler particles to be used for forming the elastic layer 12 containing with air bubbles, any of the following materials may be used: glass balloons, silica balloons, carbon balloons, phenolic balloons, acrylonitrile balloons, vinylidene chloride balloons, alumina balloons, zironia balloons, Silastic balloons, etc.

The metallic core 11 may be hollow as is the metallic core mentioned in the description of the typical fixing roller in accordance with the prior art.

On the above described elastic layer 12, a release layer 13 is formed of fluorinated resin such as perfluoroalkoxyl resin (PFA), polytetrafluoroethyene (PTFE), tetrafluoroethylene-hexafluoropropylene resin (FEP), etc. The elastic layer 12 may be coated with GLS latex. The release layer 13 may be either in the form of a piece of tube formed of substance having releasing property and fitted over the elastic layer 12, or a coat of a substance having releasing property and painted on the elastic layer 12.

Further, a temperature detecting means 14, such as a thermistor, an infrared temperature element, etc., for detecting the surface temperature of the fixing roller 10 is disposed on the downstream side of the fixing nip N in terms of the rotational direction of the fixing roller 10, and the power supply to the heat generating resistive layer 22 of the heater of the heating member 20 is controlled in response to the output of the temperature detecting means 14 in order to keep the surface temperature of the fixing roller 10 constant at a predetermined level.

2) Heating Member 20

In this embodiment, the heater 21, 22 of the heating member 20 is in the form of a piece of plate, and is relatively small in thermal capacity. To describe in more detail, the heating member 20 comprises the substrate 21, and a heat generating resistive layer 22 formed on the substrate 21. The substrate 21 is in the form of a piece of plate formed of electrically nonconductive ceramic, such as aluminum, aluminum nitride, etc., or heat resistant resin, such as polyimide, PPS, liquid crystal polymer, etc. The heat generating resistive layer 22 is formed of Ag/Pd (silver/palladium), $RuO_2$, $Ta_2N$, or the like, and is approximately 10 $\mu$m in thickness. It is in the form of a long and narrow rectangle with an approximate width of 1–5 mm, extending in the lengthwise direction of the substrate 21, and is coated on the substrate 21 with the use of screen printing, or the like.

The surface of the heater 21, 22, on the fixing roller side may be coated with a protective layer for protecting the heat generating resistive layer 22, as long as the protective layer does not adversely affect the thermal conductance.

In addition, the protective layer is desired to be thin enough to have virtually no negative effect upon the thermal conductivity, and to have positive effect upon the surface properties of the heater 22. As the material for the protective layer, the following fluorinated resins are considerable: perfluoroalkoxyl resin (PFA), polytetrafluoroethylene resin (PTFE), ethylene-tetrafluoroethylene resin (ETFE), polychlorotrifluoroethylene resin (CTEF), polyvinylidene fluoride, etc. These resins may be coated alone or in mixture. Further, dry lubricant containing graphite, diamond-like-carbon (DLC), molybdenum disulfide, and the like, as well as glass, may be considered as the material for the protective layer.

When aluminum nitride or the like, which is an excellent thermal conductor, is used as the material for the substrate 21 of the heater 21, 22, the heat generating resistive layer 22 may be formed on the opposite surface of the fixing roller 10 with respect to the fixing roller 10.

The thermally insulative stay/holder 24 for holding the heater 21,22 is formed of heat resistance resin such as liquid crystal polymer, phenolic resin, PPS, PEEK, etc. The smaller the thermal conductivity, the higher the efficiency with which the temperature of the peripheral surface of the fixing roller 10 is raised by the heat from the heater 21,22. Thus, the elastic layer 12 may be formed of a material containing hollow filler particles, for example, glass balloons, silica balloons, etc.

On the opposite side of the heater 21,22 with respect to the fixing roller 10, a temperature detecting means 23, such as a thermistor, for detecting the ceramic substrate temperature, which rises in response to the heat generation by the heat generating resistive layer 22. This temperature detecting means 23 is for controlling the temperature of the heater 21,22, and also, for watching for abnormal temperature rises.

When the temperature detecting means 23 is used for controlling the surface temperature of the fixing roller 10, the amount of the heat to be generated by the heater 21, 22 is controlled by adjusting the duty ratio, frequency, etc., of the voltage applied to the heat generating resistive layer 22 through an unshown electrode located at one of the lengthwise ends of the heating member 20, in response to the signals outputted by the temperature detecting means 14 for the fixing roller 10 and the temperature detecting means 23 for the heater 21, 22. The output of the temperature detection element 23, which is in the form of direct current, is sent to the unshown temperature control portion through an unshown DC power supply portion, DC electrodes, and an unshown connector.

The heating member 20 comprising the above described components is kept pressed against the fixing roller 10, with the interposition of the heat resistance sheet 19, by an unshown pressing means, so that the heater side of the heating member 20 is pressed against the fixing roller 10, with the heat resistant sheet 19 nipped by the heating member 20 and fixing roller 10, forming the heating nip H between the heater 21,22 and fixing roller 10.

3) Heating Resistant Sheet 19

The heat resistant sheet 19 is formed of heat resistant flexible resin, such as polyimide, polyamide imide, PEEK, RES, PPS, PFA, PTFE, FEP, etc. In order to ensure that the heat from the heater 21,22 of the heating member 20 is efficiently conducted to the fixing roller, the thickness of the heat resistant sheet 19 is made no more than 25 $\mu$m.

In order to improve the thermal conductivity of the heat resistant sheet 19, thermally conductive film, such as aluminum, alumina, AIN, or the like, may be mixed into the above listed material for the heat resistant sheet 19.

The fixing roller side of the heat resistant sheet 19 may be coated with a thin film of slippery substance such as PFA, PTFE, FEP, etc. For the purpose of reducing the contact thermal resistance between the heating member 20 (heater 21,22) and heat resistant sheet 19, it is preferable that the surface roughness of the contact area between the heating member 20 and heat resistant sheet 19 is as little as possible. Further, for the purpose of preventing the surface of the fixing roller 10 from being underheated, such grease that is heat resistant and superior in thermal conductivity may be placed between the heating member 20 and heat resistant sheet 19, so that even if the surface roughness of the contact area between the heating member 20 and heat resistant sheet 19 slightly increases, heat can still be efficiently conducted toward the fixing roller 10.

The heat resistant sheet 19 is in the form of a roll, and is fitted around a tension roller 17. It is extended between the heating member 20 and fixing roller 10, and is wound up by a take-up roller 18. The tension roller 17 and take-up roller 18 are not rotated during a printing action. Therefore, while a recording medium P is conveyed through the fixing nip N, the heat resistant sheet 19 remains stationary and in contact with the fixing roller 10. Unlike the film 33 (flexible endless member) used in conjunction with the pressing member 30, the heat resistant sheet 19 remains stationary during a printing action, and also, remains subjected to the tension generated by the tension roller 17 and heating nip H. Thus, in order to assure that the heat resistant sheet 19 withstands the tension, the thickness of the heat resistant sheet 19 is desired to be no less than 5 $\mu$m. In other words, in order to ensure that the heat from the heater 21,22 of the heating member 20 is efficiently conducted to the fixing roller 10, and also, that the heat resistant sheet 19 is satisfactory in terms of tensional strength, the thickness of the heat resistant sheet is desired to be in the range of 5 $\mu$m–25 $\mu$m.

4) Pressing Member (Backing Member) 30

The pressing member 30 has the following structure. A referential code 33 stands for a cylindrical (endless) thin film, which is heat resistant. The base layer of the film 33 is formed of heat resistant and thermally insulative resin, such as polyimide-amide, PEEK, PES, PPS, PFA, PTFE, FEP, etc. In consideration of strength, etc., the thickness of the film 33 should be no less than 20 $\mu$m and no more than 150 $\mu$m. The base layer may be coated with heat resistant resin, such as PFA, PTFE, FEP, silicon resin, etc., or the combination thereof, which are excellent in release properties. The thermal capacity of the film 33 (flexible endless member) is smaller than that of the fixing roller (rotational member) 10.

A referential code 31 stands for a slippery member disposed within the loop of the thin film 33. It is piece of heat resistant felt, mica sheet, or ceramic sheet; or a piece of sheet formed of heat resistant resin, such as liquid crystal polymer, phenolic resin, PPS, PEEK, polyimide, polyamide, etc. It is preferable that the slippery member 31 is thermally insulative. The surface of the slippery member 31 may be coated with glass, fluorinated resin, or the like, which reduces frictional resistance.

A referential code 32 stands for a thermally insulative backing holding for the slippery member 31. It is formed of heat resistant, thermally insulative, and slippery substance, for example, liquid crystal polymer, phenolic resin, PPS, PEEK, etc.

The cylindrical thin film 33 is loosely fitted around the thermally insulative holder 31, with the slippery member 31 held by the holder 31. The thermally insulative holder 31 is kept pressed against the fixing roller 10 by an unshown pressing means, forming the fixing nip N necessary for fixation, with the thin film 33 interposed between the slippery member 31 and fixing roller 10.

In this embodiment, the slippery member 31 and thermally insulative pressing holder 32 are discrete. However, they may be integrally formed for cost reduction. When they are integrally formed, the surface of the portion equivalent to the slippery member 31 may be provided with a slippery layer.

Further, in order to reduce frictional resistance, a small amount of lubricant such as grease is placed between the thin film 33 and slippery member 31. Such grease is desired to be low in thermal conductivity so that the amount by which heat is conducted from the fixing roller 10 to the slippery member 31 and thermally insulative pressing holder 32 through the thin film 33 is reduced.

5) Action

The fixing roller 10 is rotationally driven in the clockwise direction indicated by an arrow mark, by an unshown driving mechanism which transmits driving force to one of the lengthwise ends of the metallic core 11. As the fixing roller 10 is rotationally driven, the thin film 33 fitted around the pressing member 30 is subjected to rotational force, in the fixing nip N. As a result, the thin film 33 rotates around the thermally insulative pressing holder 31, sliding on the slippery member 31, in the clockwise direction indicated by another arrow mark.

To the heat generating resistive layer 22 of the heater 21,22 of the heating member 20, electrical power is supplied, quickly raising the temperature of the heater, while the power supply to the heat generating resistive layer 22 is controlled by the temperature control system inclusive of the heater temperature detecting means 23, so that the heater temperature is kept at a predetermined level after it reaches the predetermined level.

As a result, the peripheral portion of the rotating fixing roller 10 is heated by the heat from the heater 21,22, through the heat resistant sheet 19, in the heating nip H. Therefore, the temperature of the peripheral portion of the rotating fixing roller 10 quickly rises, while the surface temperature of the rotating fixing roller 10 is detected by the temperature detecting means 14, and the power supply to the heat generating resistive layer 22 of the heater 21,22 is controlled in response to the detected surface temperature of the rotating fixing roller 10 so that the peripheral surface temperature of the rotating fixing roller 10 is maintained constant at a predetermined level.

While the fixing roller 10 is rotated, with its peripheral surface temperature kept at the predetermined level suitable for image fixation, a recording medium P bearing an unfixed toner image is introduced, along a heat resistant entrance guide 15 of the thermal fixing apparatus 6, into the fixing nip N formed between the fixing roller 10 and pressing member 30, from the transfer nip A side, and is conveyed through the fixing nip N, remaining nipped by the fixing nip N. As a result, the unfixed toner image on the recording medium P is fixed by the heat and pressure applied to the recording medium P and unfixed toner image by the fixing nip N. Designated by a referential code 16 is a heat resistant exit guide of the thermal fixing apparatus 6.

6) Movement of Heat Resistant Sheet in Heating Nip H

During a printing operation carried out using an image forming apparatus structured as described above, a minute amount of offset toner and paper dust adheres to the fixing roller 10 of the thermal fixing apparatus 6, and then, transfers onto the heat resistant sheet 19, accumulating thereon, in the heating nip H. Thus, as the cumulative number of the prints increases, the amount of the offset toner and paper dust on the heat resistant sheet 19 becomes substantial. This process will be described with reference to FIG. 3, which is an enlarged view of the heating nip H formed between the heating member 20 and heater 21,22, with the interposition of the heat resistant sheet 19, by the pressure applied to the heating member 20 to keep the heating member in contact with the fixing roller 10. The minute amount of offset toner is temporarily dammed by the upstream side of the heating nip H, in terms of the rotational direction of the fixing roller 10, and melts due to heat. Then, due to the rotation of the fixing roller 10, the small amount of melted offset toner gradually travels through the interface between the heat resistant sheet 19 and fixing roller 10, toward the downstream side of the heating nip H, and then, accumulates on a portion of the heat the portion resistant sheet 19 designated by a referential code T, that is, the portion immediately next to the downstream edge of the heating nip H. If the printing operation is continued without removing the accumulated toner on the portion T, the accumulated toner is eventually returned to the peripheral surface of the fixing roller 10, and then, is carried to the fixing nip N, in which it transfers onto a recording medium P, soiling the recording medium P.

In this embodiment, therefore, the heat resistant sheet 19 is slightly slid at intervals preset in terms of print count, intervals set by a user in terms of print count, or intervals preset in terms of toner consumption, or at every paper jam. As the heat resistant sheet 19 is slightly slid, the contaminant, that is, the melted offset toner, located at a point T, or the immediately downstream edge of the heat resistant sheet 19, is moved to a point T', which is slightly away in the rotational direction of the fixing roller 10 from the downstream edge of the heating nip H.

Figure 3:
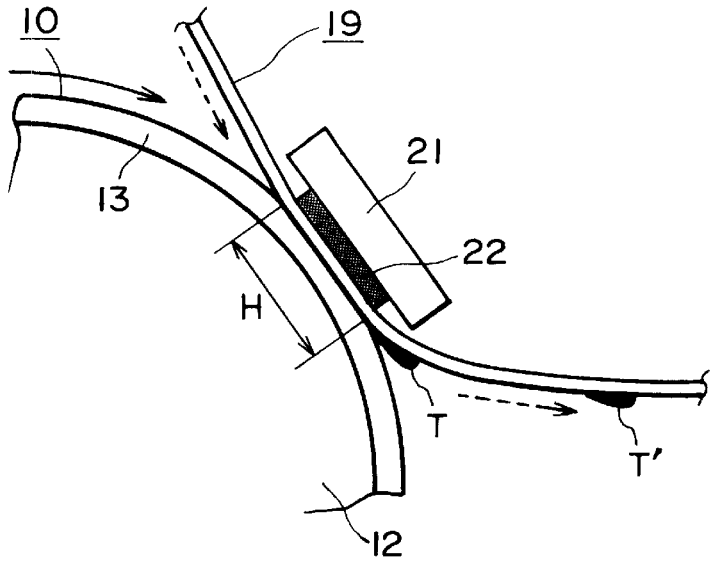
FIG. 3 is an enlarged schematic sectional view of the heating nip H in FIG. 2 and its adjacencies.

Referring to FIG. 3, once the contaminant on the heat resistant sheet 19 is moved from the point T to the point T', the contaminant cannot transfer onto the peripheral surface of the fixing roller 10, being prevented from causing a problem; it is prevented from soiling the recording medium P in the fixing nip N. The slight sliding of the heat resistant sheet 19 is effected by the rotation of the tension roller 17 and take-up roller 18. The take-up roller 18 winds the heat resistant sheet 19 so that the surface of the heat resistant sheet 19, on which the contaminant, or offset toner, is present, faces inward, minimizing the possibility that the contaminant (offset toner) on the heat resistant sheet 19 will becomes separated from the heat resistant sheet 19 and contaminate the fixing apparatus and the interior of the image forming apparatus.

7) Evaluations

The above described thermal fixing apparatus 6 was evaluated in terms of:

(1) the time it takes for the peripheral surface temperature of the fixing roller 10 to rise from the normal temperature of 25° C. to 200° C.; and (2) the fixing performance under the condition that a recording medium P bearing an unfixed toner image is introduced into the fixing nip N eight seconds after the reception of a print signal by an image forming apparatus In the experiments, five heat resistant sheets 19, which are formed of polyimide and different in thickness, were tested.

The heater 21,22 was made by screen printing a 3 mm wide heat generating resistive layer 22 on the substrate 21 formed of alumina. The heat generating resistive layer 22 was placed in contact with the heat resistant sheet 19, with the provision of no protective layer, or the like, on the heat generating resistive layer 22. The electrical power supplied to the heat generating resistive layer 22 of the heater 21,22 was fixed at 800 W. The peripheral velocity of the fixing roller 10 was set to 200 mm/sec. During the evaluations, the heat resistant sheet 19 was not moved.

As for the fixing roller 10, two types of fixing rollers 10 were tested: a solid rubber type comprising a metallic core 11 formed of aluminum, and a 4 mm thick elastic layer of silicon rubber formed on the metallic core 11; an air bubble filled rubber type comprising a metallic core 11 formed of aluminum, and a 4 mm thick elastic layer formed on the peripheral surface of the metallic core 11, of silicon rubber in which hollow filler particles were dispersed. Each fixing roller 10 was covered with a PFA tube 13 as a surface layer.

For comparison, a fixing apparatus which did not have the heat resistant sheet 19 between the heating member 20 and fixing roller 10 in the heating nip H was also tested in terms of (1), or the startup time.

The results are shown in Table 1, in which G stands for excellent performance; F stands for tolerable performance; and NG stands for intolerable performance.

TABLE 1

| | Comp. Ex. | Emb. 1 | Emb. 2 | Emb. 3 | Emb. 4 | Emb. 5 |
|---|---|---|---|---|---|---|
| (1) Solid rubber type | | | | | | |
| Sheet thickness ($\mu$m) | 0 | 5 | 10 | 25 | 30 | 40 |
| Temp. rising time (sec) | 6.2 | 6.4 | 6.9 | 9.0 | 9.9 | 12.4 |
| Fixing performance | G | G | F | NG | NG | NG |
| (2) Porous rubber type | | | | | | |
| Sheet thickness ($\mu$m) | 0 | 5 | 10 | 25 | 30 | 40 |
| Temp. rising time (sec) | 4.0 | 4.2 | 4.5 | 5.6 | 6.3 | 7.9 |
| Fixing performance | G | G | G | G | F | NG |

G: Good,
F: Fair,
NG: No good

The following is evident from Table 1: In terms of the rising speed of the peripheral surface of the fixing roller 10 and fixing performance, the fixing rollers having the elastic layer 12 formed of air bubble filled rubber, which was superior in thermal insulation, was superior to the fixing rollers having the elastic layer 12 formed of solid rubber.

In terms of the tolerable range of the thickness of the heat resistant sheet 19 placed between the fixing roller 10 and heating member 20, the fixing rollers of the air bubble filled rubber type were greater than the fixing rollers of the solid rubber type.

Even for the fixing rollers 10 of the air bubble filled rubber type, the tolerable thickness of the heat resistant sheet 19 was no more than 30 $\mu$m, preferably, no more than 25 $\mu$m. In particular, in the case of the heat resistant sheet 19, the thickness of which was excessive, once the peripheral surface temperature of the fixing roller 10 fell in the fixing nip N, it could not be raised back to the level, at which satisfactory fixation was possible, by the heating member 20. As a result the fixing performance gradually declined as image formation was continued.

As is evident from the results from the comparative tests, the thermal heating apparatus having no heat resistant sheet 19 between the heating member 20 and fixing roller 10 was superior in the rising speed of the peripheral surface temperature of the fixing roller, as well as fixing performance. However, after 10,000 prints were continuously produced using cut papers, that is, after 10,000 toner images were continuously fixed, the toner particles having collected on the heater began to be expelled onto the recording medium P, soiling the recording medium P.

In comparison, the thermal fixing apparatuses having the heat resistant sheet 19 between the heating member 20 and fixing roller 10 could thermally fix unfixed toner images, without soiling recording medium P, even after no less than 30,000 prints were produced, as long as the heat resistant sheet 19 was slid every 8,000 prints.

When thermally conductive grease was placed in the contact area between the heating member 20 and heat resistant sheet 19, the rising speed of the peripheral surface temperature of the fixing roller 10 increased, enhancing the fixing performance.

As described above, in this embodiment, the thermal fixing apparatus is provided with the fixing roller 10 having the elastic layer 12; the heating member (heater) which is in the form of a plate and is small in thermal capacity, and which is for externally heating the peripheral surface of the fixing roller 10, through the thin heat resistant sheet 19, in the heating nip H; and the pressing member (backing means) 30 which is kept pressed against the fixing roller 10 to form the fixing nip N, and as a recording medium P bearing an unfixed toner image is conveyed through the fixing nip N, remaining nipped by the fixing roller 10 and pressing member 30, the unfixed toner image on the recording medium P is fixed to the recording medium P. Therefore, the thermal fixing apparatus in this embodiment is shorter in the time necessary for the peripheral surface temperature of the fixing roller to increase, and is excellent in fixing performance. Also, the contaminants such as toner particles, paper dust, etc., having accumulated in the adjacencies of the heating nip H are removed by sliding, every predetermined number of prints, the thin heat resistant sheet 19 between the above described plate-like heating member and fixing roller. Therefore, the toner particles having accumulated in the adjacencies of the heating nip are prevented from appearing on the recording medium P by way of the fixing roller 10.

Further, the efficiency with which heat conducts from the heating member 20 to fixing roller 10 is improved by making the heat resistant sheet 19 thinner (5 $\mu$m–25 $\mu$m). Therefore, electrical power supply is not required during a standby period; wait time and fast print time are shorter; the halftone images or the like are less likely to unevenly fixed or made rough in surface texture. In other words, according to this embodiment, it is possible to a thermal fixing apparatus capable of achieving high image quality.

In this embodiment, the heat resistant sheet 19 between the heating member 20 and fixing roller 10 was slid every predetermined number of prints, in order to prevent the contaminants on the heat resistant sheet 19 from transferring onto the recording mediums P. The market offers various recording media, and the performance of a thermal fixing apparatus in terms of offset is affected by recording medium properties. Therefore, even if the thermal fixing apparatus in this embodiment is employed, it is possible that when the heat resistant sheet 19 begins to become critically contaminated depends on who uses the image forming apparatus. Thus, it may be made possible for a user to freely set the intervals at which heat resistant sheet 19 is slid, or to enter an instruction for sliding the heat resistant sheet 19 as the contaminants on the recording medium becomes conspicuous, using the control panel of an image forming apparatus.

Further, the heat resistant sheet 19 may be slid according to the cumulative amount of the consumed toner predictable by counting the pixels of the images formed on the photoconductive drum 1 in an image forming apparatus, or may be slide when it is highly possible that the heat resistant sheet 19 has been excessively contaminated, for example, immediately after a recording medium has become jammed in the image forming apparatus. In other words, the timing for sliding the heat resistant sheet 19 is optional.

Further, in this embodiment, during thermal fixation, the heat resistant sheet 19 between the fixing roller 10 and heating member 20 was kept stationary, and the peripheral surface of the fixing roller 10 slid on the stationary heat resistant sheet 19. However, the thermal fixing apparatus may be structured so that the heat resistant sheet 19 is slid in the rotational direction of the fixing roller 10, at an extremely slow velocity, in comparison to the peripheral velocity of the fixing roller 10, for example, at a velocity of 1 mm per 1,000 A4 size cut papers. Such a structural arrangement also can produce the same effects as those described above.

Further, in the case of an image forming apparatus in which the image forming portion employs a process cartridge system comprising: developing apparatuses exchangeable as the toner there is depleted; cartridges containing toner; etc., (system may comprise photoconductive drum 1, charging apparatus 2, etc., as does cartridge 73 in this embodiment), it may be structured so that each time the cartridge therein is replaced, the heat resistant sheet 19 between the fixing roller 10 and heating member 20 is slid. With the employment of this system, each time the cumulative amount of the toner consumption reaches an approximately fixed quantity, the heat resistant sheet 19 is slid so that the uncontaminated portion of the heat resistant sheet 19 moves into the interface between the fixing roller 10 and heating member 20, without being noticed by a user. Also, the complicated structural arrangement described above is unnecessary; the image forming apparatus is simpler in structure.

Figure 4:
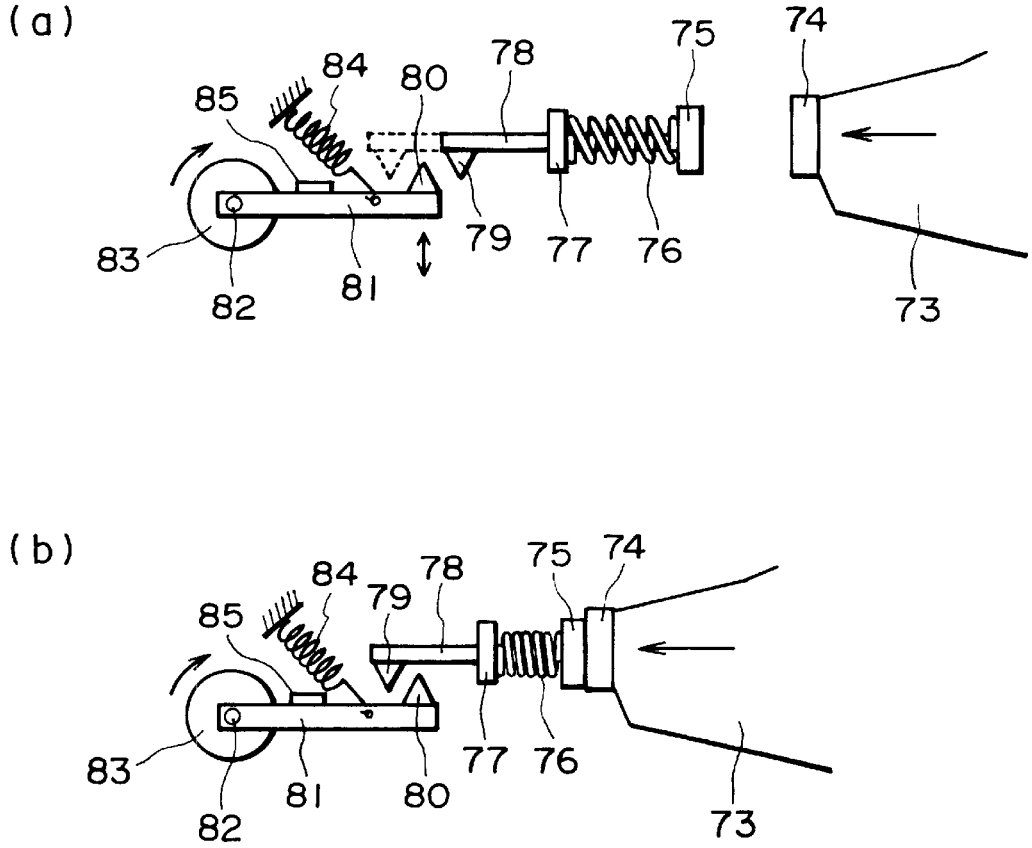
FIG. 4 is a drawing for depicting the mechanism for sliding the sheet placed between the fixing roller and pressing member, in the heating nip H.

Next, this system will be described referring to FIGS. 4(*a*) and 4(*b*). In FIG. 4, a referential code 73 stands for an exchangeable process cartridge comprising a developing apparatus, toner, a photoconductive drum, a charging apparatus, etc., or a lid which covers the cartridge entrance of an image forming apparatus, through which a cartridge is removably mounted into the image forming apparatus. A referential code 74 stands for a projection which moves in the direction indicated by an arrow mark, when the cartridge 73 is mounted or when the cover 73 is closed. A referential code 78 stands for a shaft which is inserted through a stationary bearing 77, being thereby supported by the bearing 77, so that the shaft is allowed to move in the horizontal direction of the drawing. A referential code 75 stands for a bumper portion attached to one end of the shaft 78 to catch the projection 74. As the projection 74 moves in the arrow direction, the bumper portion 75 is pressed by the projection 74. As a result, the shaft 78 solidly connected to the bumper portion 75 is moved leftward in the drawing.

Designated by a referential code 76 is a spring disposed between the bearing 77 and bumper portion 75. As the bumper portion 75 moves leftward in the drawing, a predetermined amount of expansive pressure is built up in the spring 76.

Designated by a referential code 79 is a triangular projection 79, which is attached to the end of the shaft 78, on the side opposite to the bumper portion 75, and which is an integrally formed part of the shaft 78. It is moved leftward in the drawing, by the leftward movement of the shaft 78 in the drawing.

A referential code 81 stands for a shaft which can be oscillated in the direction indicated by an arrow. One end of the shaft 81 is provided with a triangular projection, and the other end of the shaft 81 is fixed to a shaft 82. The oscillatable shaft 81 is suspended from above by a spring 84, one end of which is fixed to its mount. The upward movement of the shaft 81 is regulated by a stationary plate 85. The shaft 82 is provided with a one-way clutch 83, which transmits rotational force only in one direction, that is, the direction indicated by an arrow mark, as the shaft 82 rotates. The one-way clutch 83 may be a part of the take-up spool 18 in this embodiment shown in FIG. 2, or such a clutch that rotates the take-up spool 18 through a driving force transmitting member.

With the provision of the above described structural arrangement, as the triangular projection 79 moves to the left in the drawing, it comes into contact with the triangular projection 80 located at the end of the oscillatable shaft 81. As the triangular projection 79 is further moved, the shaft 81 is moved downward in the drawing, rotating the one-way clutch 82 in the arrow direction. As the projection 79 is further moved, it becomes disengaged from the projection 80, allowing the oscillatable shaft 81 to be moved upward by the resiliency of the spring 84 until its movement is blocked by the stationary plate 85. When removing the cartridge 73 from the image forming apparatus, the bumper portion 75 is moved rightward in the drawing by the reactive force of the spring 76 kept compressed between the stationary bearing 76 and bumper portion 75. As a result, the shaft 78 and its projection 79 are moved right in the drawing, coming into contact with the triangular projection 80 and moving it downward while rotating the one-way clutch a predetermined angle.

Figure 12:
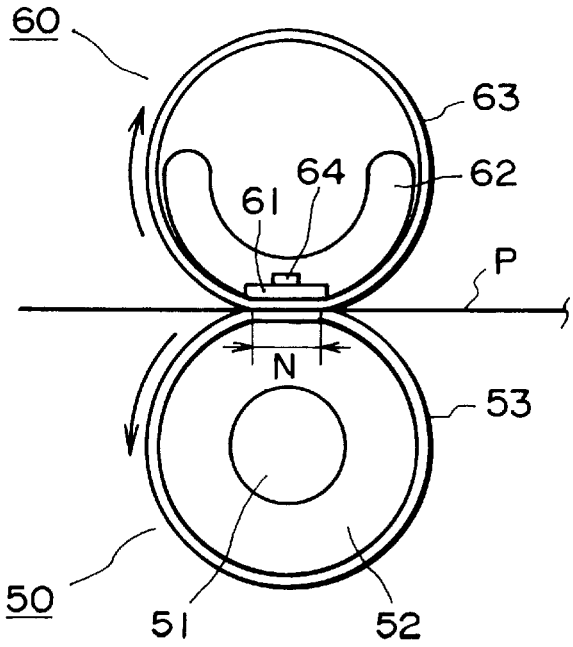
FIG. 12 is a sectional view of an example of a thermal heating apparatus in accordance with the prior art, which employs a fixing film.

In other words, with the provision of the above described structural arrangement, a the cartridge entrance cover of the image forming apparatus is opened or closed in order to replace an empty cartridge (depleted of toner) with a full cartridge (full of toner), or as a cartridge is inserted into, or removal from, the image forming apparatus, the one-way clutch 83 is rotated a predetermined angle. This rotation of the one-way clutch rotates a predetermined angle the take-up spool 18 shown in FIG. 12, and this rotation of the take-up spool 18 slides the heat resistant sheet 19 by a predetermined distance, without being noticed by a user. In other words, as the cartridge runs out of toner, that is, as the cumulative amount of toner consumption reaches a fixed quantity, a cartridge is replaced with a fresh one, causing the heat resistant sheet 19 between the fixing roller and heating member in this embodiment to be slid a predetermined distance; the heat resistant sheet 19 can be slid with the provision of a simpler structural arrangement.

In the structure described above, the one-way clutch 83 is rotated by a predetermined angle to slide the heat resistant sheet 19. However, a means for sliding the heat resistant sheet 19 is optional. For example, it may be a mechanical means other than the above described one, an electrical means, etc.

[Embodiment 2]

Next, the second embodiment of the present invention will be described. The structure of the image forming apparatus in this embodiment is the same as that in the first embodiment. Therefore, it will not be described to avoid the repetition of the same description.

In this embodiment, the heating member is made arcuate on the fixing roller side, so that the heating member conforms in shape to the fixing roller, with the interposition of the heat resistant sheet. Therefore, heat is more efficiently conducted from the heating member to the fixing roller.

Figure 5:
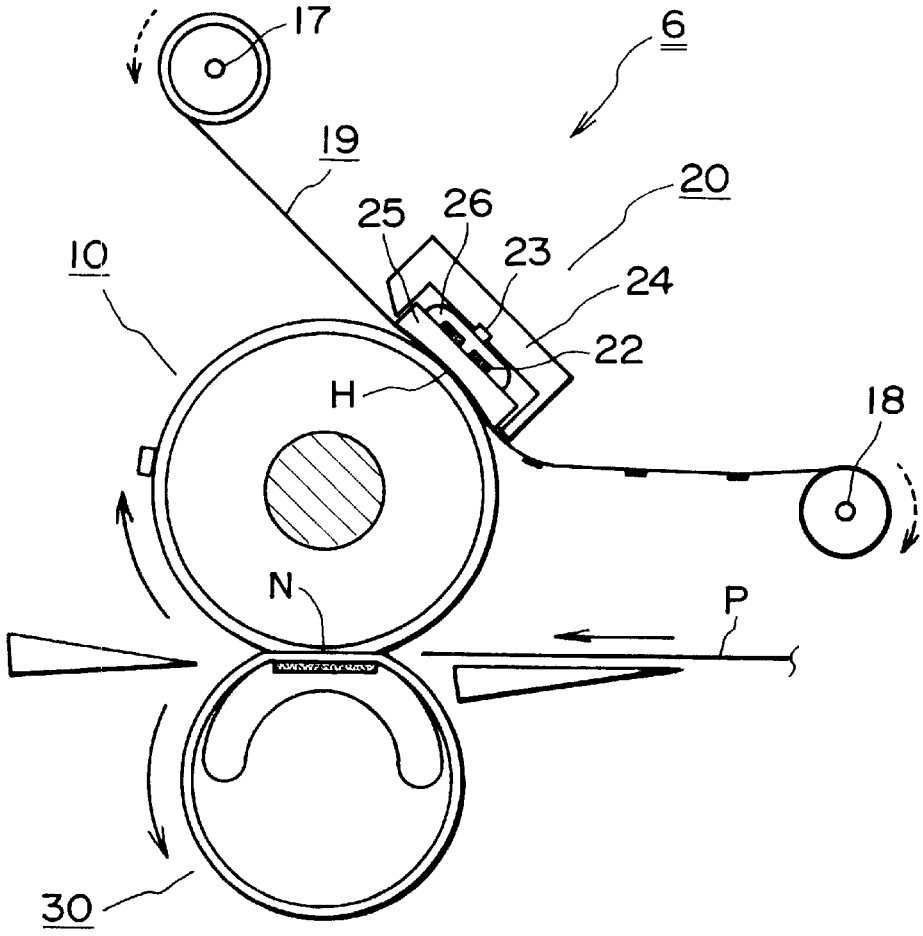
FIG. 5 is a sectional view of the image heating apparatus in the second embodiment of the present invention.
Figure 6:
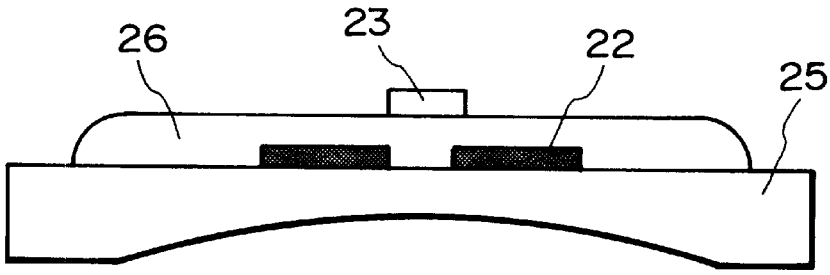
FIG. 6 is an enlarged sectional view of the heater in FIG. 5.

The details of the structures of the thermal fixing apparatus and its heater, in this embodiment, are shown in FIGS. 5 and 6. The structures of the fixing roller (rotational member) 10 and pressing member (backing means) 30 are the same as those in the first embodiment. Therefore, they will not be described to avoid repeating the same descriptions. The structure of the heater of the heating member 20 is as follows. That is, a referential code 25 stands for the substrate for the heater formed of ceramic, such as aluminum, aluminum nitride, etc., or heat resistant resin, such as polyimide, PPS, liquid crystal polymer, etc., and a referential code 22 stands for a heat generating resistive layer formed on the heater substrate 25, extending in the lengthwise direction of the substrate 25, as was in the first embodiment.

In order to electrically insulate the heat generating resistive layer 22, and a temperature detection element 23 such as a thermistor, they are coated with a protective layer 26 formed of glass or the like. From the standpoint of thermal efficiency, this protective layer 26 is desired to be lower in thermal conductivity than the substrate 25, because when the protective layer is lower in thermal conductivity than the substrate 25, the amount by which heat is conducted to the fixing roller is greater than otherwise.

Referring to FIG. 6, the substrate 25 for the heater 25,22,26 is made arcuate, at least on the fixing roller 10 side which is placed in contact with the heat resistant sheet 19, so that the contour of the heater 25,22,26 conforms to that of the fixing roller 10, with the interposition of the heat resistant sheet 19. Instead of this structural arrangement, however, a flexible heater may be disposed so that its contour conforms that of the fixing roller 10.

Figure 7:
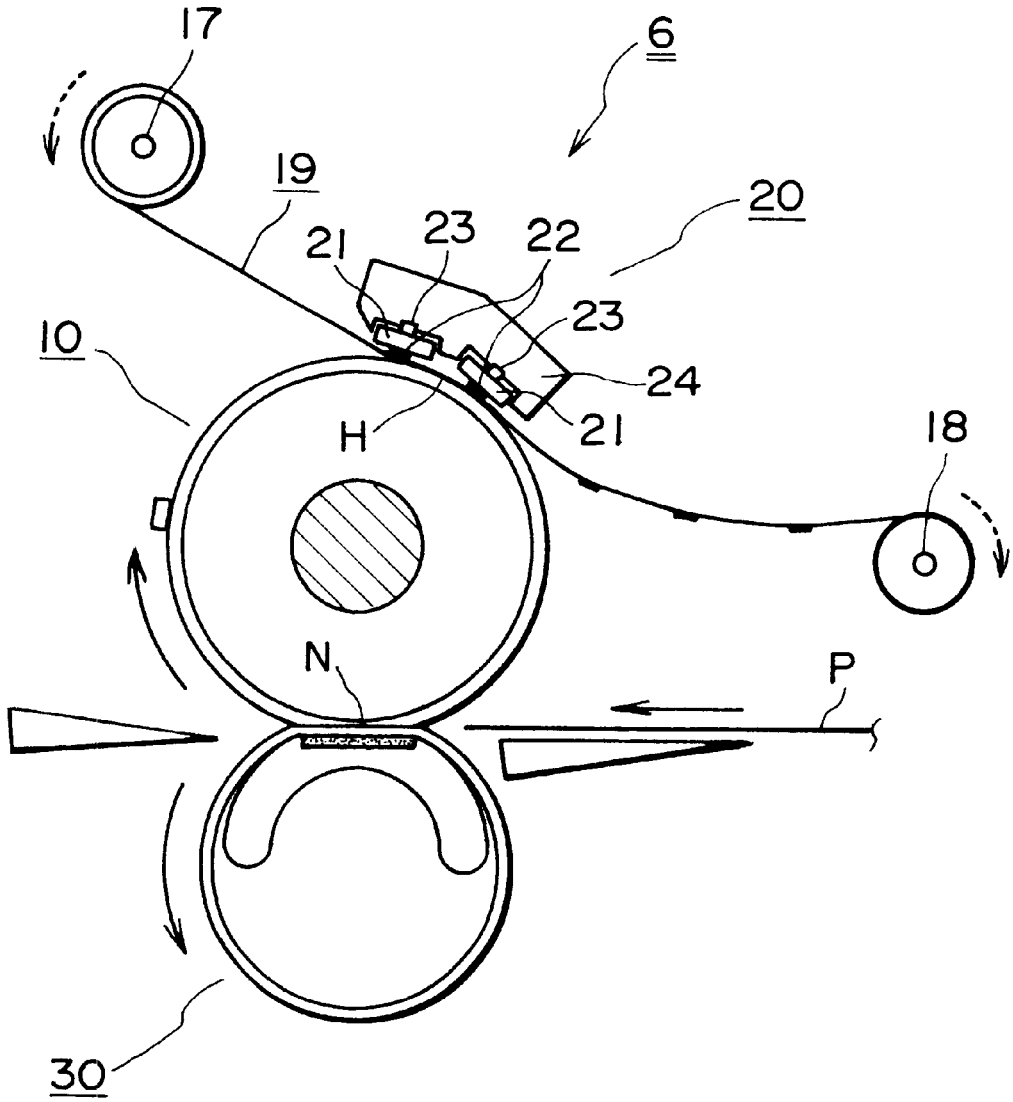
FIG. 7 is a sectional view of the image heating apparatus in the second embodiment of the present invention, for showing the structure thereof.

Further, a plurality of heaters may be disposed as shown in FIG. 7 so that the peripheral surface of the fixing roller 10 is uniformly heated through the heat resistant sheet 19.

With the provision of the above described structural arrangement, the surface area of the heating nip H, in which the heater 25,22,26 is pressed against the peripheral surface of the fixing roller 10 with the interposition of the heat resistant sheet 19, is increased, allowing a greater amount of heat to be transferred in the heating nip H. Therefore, the peripheral surface of the fixing roller is heated faster, reducing the electrical power consumption. In other words, this embodiment of the present invention makes it possible to provide an energy efficient thermal fixing apparatus.

Further, according to this embodiment, the heater 25,22,26 is shaped so that its contour conforms to that of the fixing roller 10, reducing the contact pressure between the heating member 20 and fixing roller 10. Therefore, it is possible to reduce the amount of the torque necessary for rotationally driving the fixing roller 10.

Further, according to this embodiment, it is possible to reduce the tension generated in the portion of the heat resistant sheet 19 between the tension roller 17 and heating member 20, making less likely to occur, the breakage problems traceable to the tension of the heat resistant sheet 19, for example, the problem that the heat resistant sheet 19 fails to withstand the tension and tear, and also, making it possible to reduce the damage to the peripheral surface of the fixing roller 10. Therefore, it is possible to provide a thermal fixing apparatus which is more durable than a thermal fixing apparatus in accordance with the prior art.

In order to confirm the above described effects, a group of thermal fixing apparatuses (comparative examples) in which the heater was made straight on the fixing roller side, and another group of thermal fixing apparatuses (embodiments), were measured in the amount of the torque necessary to rotate the fixing roller, the durability of the fixing roller, and the fixing performance.

In all the heaters used for the evaluations, the substrate width was 10 mm, and the contact pressure between the heater and fixing roller was varied in the range of 4 kgf–10 kgf to vary the width of the heating nip H.

The results are given in Table 2. The symbols representing the fixing performance evaluations are the same as those in the first embodiment. The durability was evaluated in terms of the number of prints (unit of 10,000) produced before image defects traceable to the deterioration (roughening) of the peripheral surface of the fixing roller began to occur while the prints were continuously produced using cut papers. The unit of the torque was kgf.cm.

TABLE 2

| | Pressure (kgf) | Nip width (mm) | Driving torque | Durability | Fixing performance |
|---|---|---|---|---|---|
| Comp. Ex. 1 | 4 | 4.9 | 3.5 | ≧80 | NG |
| Comp. Ex. 2 | 6 | 6.0 | 4.2 | 70 | NG |
| Comp. Ex. 3 | 8 | 7.2 | 5.0 | 57 | F |
| Comp. Ex. 4 | 10 | 8.0 | 5.9 | 35 | G |
| Emb. 1 | 4 | 10 | 3.7 | ≧80 | G |
| Emb. 2 | 6 | 10 | 4.5 | 68 | G |
| Emb. 3 | 8 | 10 | 5.3 | 55 | G |
| Emb. 4 | 10 | 10 | 6.4 | 30 | G |

G: Good,
F: Fair,
NG: No good.

The following is evident from the results given above. When the contact pressure is kept constant, the thermal fixing apparatuses in accordance with this embodiment is greater in the amount of the torque necessary to drive the fixing roller than the thermal fixing apparatuses in which the surface of the heater facing the fixing roller is straight. Further, the former are inferior in durability to the latter. It is conceivable that this is due to the wider heating nip H of the former. On the contrary, in terms of the fixing performance, the former, in which the heating member 20 is made arcuate on the fixing roller side, are superior to the latter, even when the contact pressure is lower. In the table, Comparative Embodiment 4 and Embodiment 1 of the present invention are equal in fixing performance. From this comparison, it is evident that those in accordance with the present invention are superior in both the torque and durability to those in accordance with the comparative embodiments.

As described above, in this embodiment, a heating nip H wider than that in accordance with the prior art is realized by making the heating member arcuate on the fixing roller side, so that the contour of the heating member conforms to that of the fixing roller, with the interposition of the heat resistant sheet, or disposing a plurality of heaters around the fixing roller. Therefore, heat is more efficiently transferred to the peripheral surface of the fixing roller; it requires less torque to drive the fixing roller; the tension generated in the heat resistant sheet is smaller; and the damage to the peripheral surface of the fixing roller is smaller. In other words, according to this embodiment, it is possible to provide a thermal heating apparatus which is more durable than a thermal heating apparatus in accordance with the prior art.

In Table 2, the pressing forces and driving torques are expressed in units [kgf] and [kgf.cm], respectively, which do not belong to the International System of Units. Given below are the pressing forces and driving torques expressed in units [N] and [N.cm], respectively, which belong to the International System of Units:

4 kgf=39.2 N; 6 kgf=58.8 N; 8 kgf=78.4 N; 10 kgf=98.0 N; 3.5 kgf.cm=34.3 N.cm; 4.2 kgf.cm=41.2 N.cm; 5.0 kgf.cm=49.0 N.cm; 5.9 kgf.cm=57.8 N.cm; 3.7 kgf.cm=36.3 N.cm; 4.5 kgf.cm=44.1 N.cm; 5.3 kgf.cm=51.9 N.cm; and 6.4 kgf.cm=62.7 N.cm.

[Embodiment 3]

Next, the third embodiment of the present invention will be described. The overall structure of the image forming apparatus in accordance with this embodiment is the same as that in accordance with the first embodiment shown in FIG. 1. Therefore, it will not be described to avoid repeating the same descriptions.

This embodiment is characterized in that, in the pressing means against which the fixing roller is pressed to form the fixing nip between the pressing means and fixing roller, the slippery member for guiding the rotatable thin film is made arcuate at least on the upstream side, in terms of the recording medium conveyance direction, in order to make the thin film path conform in shape to the peripheral surface of the fixing roller.

Figure 8:
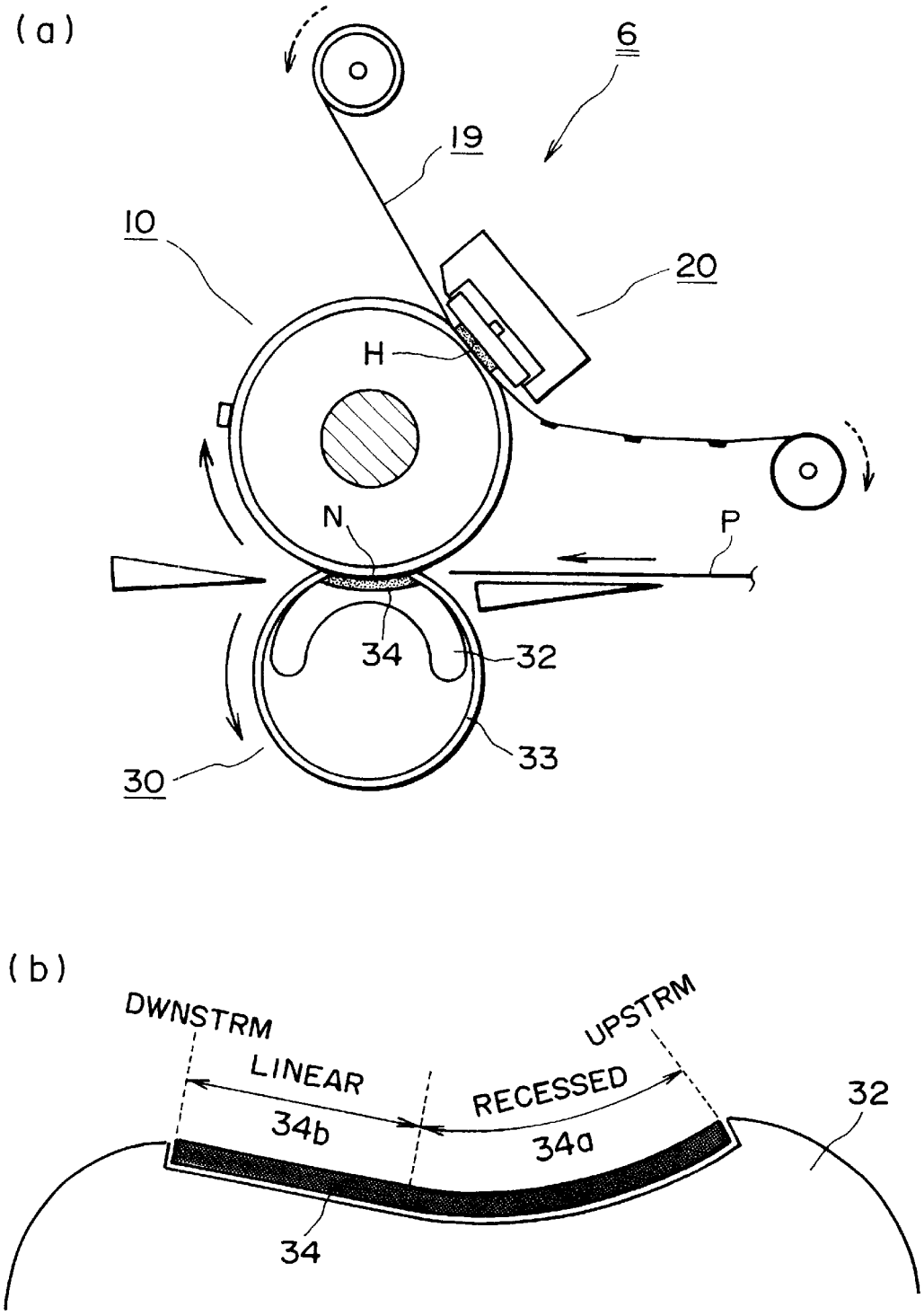
FIG. 8(*a*) is a sectional view of the image heating apparatus in the third embodiment of the present invention, and FIG. 8(*b*) is an enlarged sectional view of the slippery member, which forms the fixing nip, and its adjacencies.

The structure of the thermal fixing apparatus in accordance with this embodiment, and the details of the configuration of the slippery member of the pressing member, are shown in FIGS. 8(*a*) and 8(*b*). In the drawings, a thermally insulative slippery member 34 attached to the thermally insulative pressing holder 32 is made arcuate at least on the upstream side 34*a* in terms of the recording medium conveyance direction, in the fixing nip N; at least the upstream side 34*a* of the slippery member 34 is made to conform in shape to the fixing roller, in the fixing nip N. The downstream side 34*b* of the slippery member 34 is made straight in order to prevent a recording medium from curling more or less toward the fixing roller as it is discharged.

In other words, according to this embodiment, even if the pressure applied to the fixing roller 10 is small, the fixing nip N for supplying heat from the fixing roller 10 to a recording medium P is made wide enough for the satisfactory heat transfer from the fixing roller 10 to the recording medium P. Therefore, it is possible to reduce the torque necessary to drive the fixing roller 10 while providing satisfactory fixing performance. In addition, there is a possibility that since the pressure applied to the fixing roller 10 is smaller, the fixing roller 10 will last longer.

In order to confirm the above described effects of this embodiment, the thermal fixing apparatuses in accordance with the second third embodiment of the present invention were evaluated in the torque, fixing performance, and curling of a recording medium P.

In these experiments, the sum of the widths of the straight portion 34*b* and arcuate portion 34*a* of the slippery member 34 was 10 mm, and the width of the portion of the arcuate portion 34*a* in the fixing nip N was varied within the range of 0 mm–10 mm. The pressures applied for the evaluation were 8 kgf (78.4 N) and 12 kgf (117.6 N).

The results of the evaluation are given in Table 3. Regarding the curling, G means that curling was no more than 10 mm; F means that curling was no more than 20 mm; and NG means that curling was no less than 20 mm. The symbols for the evaluations of the other factors are the same as those in the second embodiment.

TABLE 3

| Arcuation length (mm) | Nip width (mm) | Driving torque | Fixing performance | Curling |
|---|---|---|---|---|
| | | (1) Pressure = 8 kgf | | |
| 0 | 6.5 | 2.9 | NG | G |
| 2 | 7.0 | 3.0 | F | G |
| 4 | 7.6 | 3.1 | G | G |
| 6 | 8.3 | 3.2 | G | G |
| 8 | 9.1 | 3.3 | G | F |
| 10 | 10 | 3.4 | G | NG |
| | | (2) Pressure = 12 kgf | | |
| 0 | 7.0 | 3.7 | F | G |
| 2 | 7.4 | 3.8 | G | G |
| 4 | 7.9 | 4.0 | G | G |
| 6 | 8.5 | 4.1 | G | F |
| 8 | 9.2 | 4.3 | G | NG |
| 10 | 10 | 4.5 | G | NG |

G: Good,
F: Fair,
NG: No good.

It is evident from the above results that making the slippery portion of the pressing member 30 arcuate increases the amount of the heat conduction to a recording medium P, improving the fixing performance. The increase, however, is not substantial, because heat is not generated in the fixing nip N. Nevertheless, it is possible to reduce the pressure applied to the fixing roller. Therefore, it is possible to reduce the torque for driving the fixing roller, and the torque reduction adds to the durability of the fixing roller.

As described above, according to this embodiment, the slippery member 34 on which the thin film 33 of the pressing member 30 slides is made arcuate at least on the upstream side 34*a* in terms of the recording medium conveyance direction, in order to make the path of the thin film 33 conform to the contour of the fixing roller 10. Therefore, the contact pressure necessary for a thermal fixing apparatus in accordance with this embodiment to form a fixing nip wide enough for satisfactory image fixation does not need to be as high as that in a thermal fixing apparatus in accordance with the prior art. Further, it is possible to improve the fixing performance, reduce the torque for driving the fixing roller, and add to the durability of the fixing roller.

In Table 3, the pressing forces and driving torques are expressed in units [kgf] and [kgf.cm], respectively, which do not belong to the International System of Units. Given below are the pressing forces and driving torques expressed in units [N] and [N.cm], respectively, which belong to the International System of Units:

2.9 kgf=28.4 N; 3.0 kgf=29.4; 3.1 kgf=30.4 N; 3.2 kgf=31.4 N; 3.3 kgf.cm=32.3 N.cm; 3.7 kgf.cm=36.3 N.cm; 3.8 kgf.cm=37.2 N.cm; 4.0 kgf.cm=39.2 N.cm; 4.1 kgf.cm=40.2 N.cm; 4.3 kgf.cm=42.1 N.cm; and 4.5 kgf.cm=44.1 N.cm.

[Embodiment 4]

Next, the fourth embodiment of the present Invention will be described. The overall structures of the image forming apparatus and thermal fixing apparatus in accordance with this embodiment is the same as those in the first embodiment shown in FIGS. 1 and 2. Therefore, they will not be described to avoid repeating the same descriptions.

This embodiment is characterized in that the heat resistant sheet 19 between the heating member 20 and fixing roller 10 are reinforced by increasing the thickness of its lateral edges, or adding reinforcing members to its lateral edges, enabling the heat resistant sheet 19 to better withstand the tension created in the portion of the heat resistant sheet 19 between the tension roller 17 and heating member 20, in order to prevent the inconveniences such as the tearing of the heat resistant sheet 19.

Figure 9:
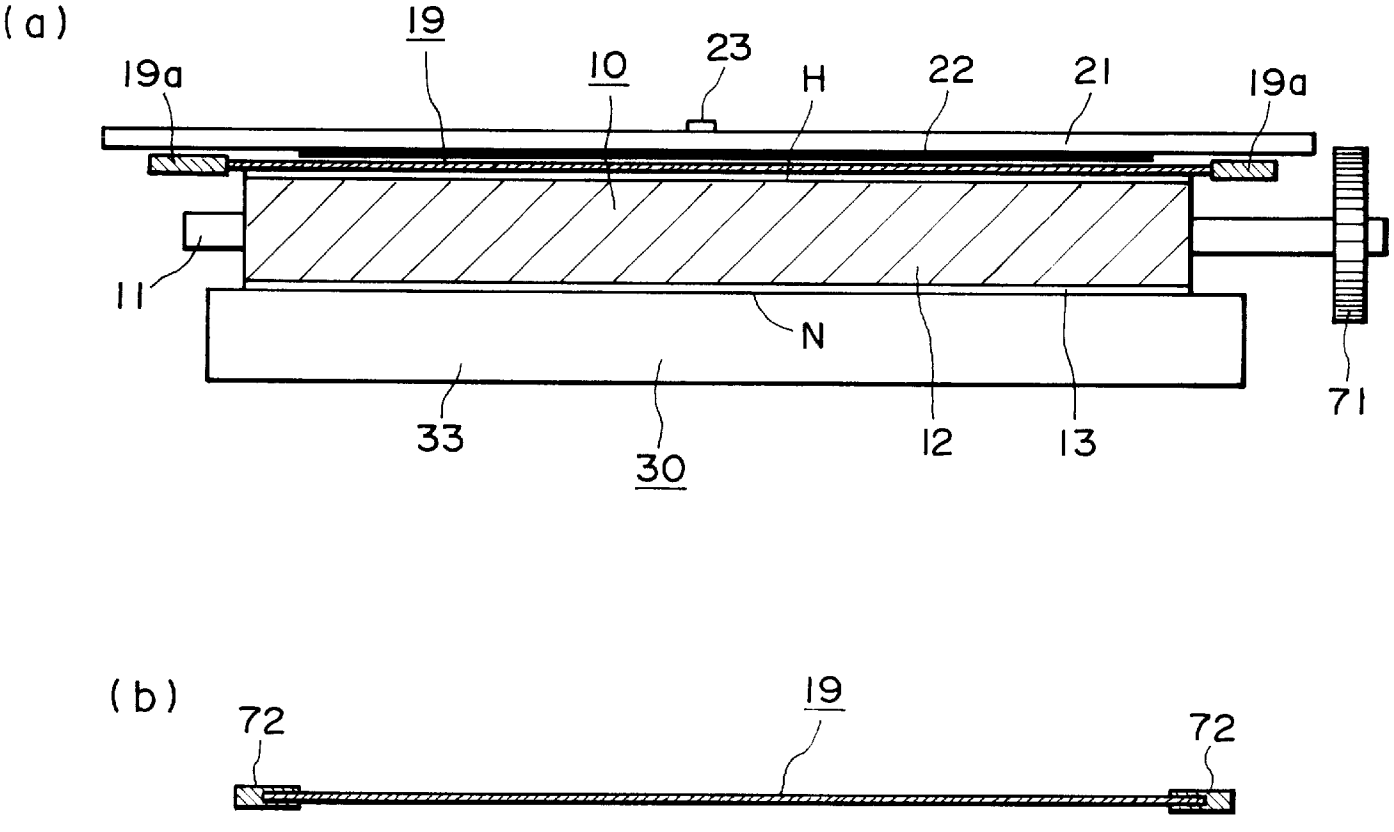
FIG. 9(*a*) is a lengthwise sectional view of the image heating apparatus in the fourth embodiment of the present invention, and FIG. 9(*b*) is a lengthwise sectional view of the heat resistant sheet.

FIG. 9(*a*) is a lengthwise sectional view of the thermal fixing apparatus in accordance with this embodiment. Referring to the drawing, one end of the metallic core 11 of the fixing roller 10 is provided with a gear 71, through which the fixing roller 10 is rotationally driven. The heat resistant sheet 19 placed between the release layer 13 of the fixing roller 10 and the heat generating resistive layer 22 of the heater 21,22 of the heating member, as in the first embodiment, is thickened across the portions 19*a*, that is, the portions next to the lateral edges and outside the recording medium conveyance path, preferably, outside the range of the elastic layer of the fixing member 10. In order to efficiently transfer the heat generated in the heater 21,22, to the fixing roller 10, not only is it desired to reduce the thickness of the heat resistant sheet 19 between the fixing roller 10 and heating member 20, but also to disperse thermal conduction enhancement filler, such as BN, aluminum powder, alumina powder, aluminum nitride powder, etc., in the material for the heat resistant sheet 19. However, a thinner heat resistant sheet made of such a material is low in tear resistance, being likely to easily tear when subjected to tension. In particular, if its lateral edges have defects, such as burrs, steplike portions, etc., the heat resistant sheet 19 is likely to break at the defects; a tear is likely to develop from the defects. Thus, in order to make the heat resistant sheet 19 more resistant to the tension created in the portion of the heat resistant sheet 19 between the tension roller 17 and heating member 20, the heat resistant sheet 19 is thickened, in particular, along the lateral edges which are thought to be inherently weak. Therefore, it is possible to provide a much stronger heat resistant sheet 19 capable of withstanding the greater amount of tension.

Further, referring to FIG. 9(*b*), as a method for reinforcing the thin heat resistant sheet 19, reinforcing members 72 formed of the same material as that of the heat resistant sheet 19, or a material different therefrom, may be glued or welded to the thin heat resistant sheet 19 along the lateral edges.

Hereinafter, the fifth to eighth embodiments of the present invention will be described, in which the heat resistant sheet 19 employed by the above described first to fourth embodiments is eliminated in order to improve the efficiency with which the peripheral surface of the rotational member (fixing roller) is heated. The fixing roller (rotational member) 10, heating means 20, and backing member 30 in the fifth to eighth embodiments are the same as those in the first embodiment. Therefore, their description will not be given.

[Embodiment 5]

Figure 13:
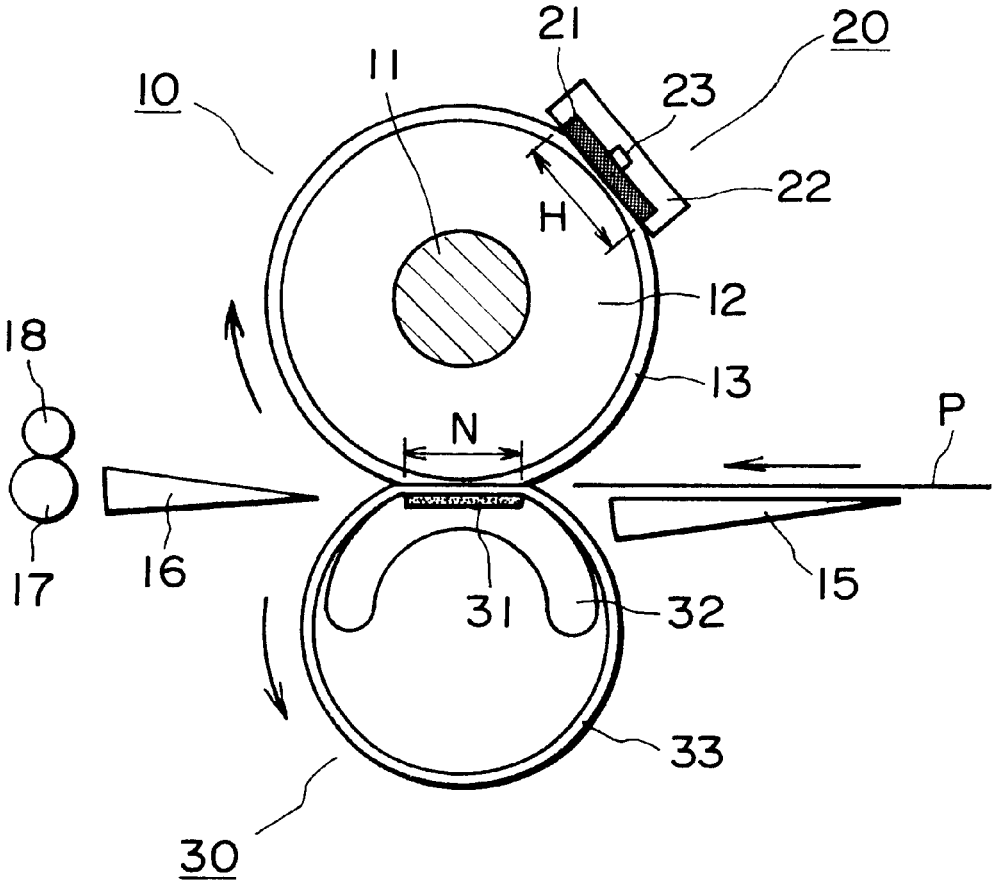
FIG. 13 is a sectional view of the image heating apparatus in the fifth embodiment of the present invention.

FIG. 13 shows the structure of the image heating apparatus in accordance with the fifth embodiment of the present invention. This image heating apparatus is different from that in accordance with the first embodiment in that no heat resistant sheet is placed between the fixing roller and heating means.

In this structure, the fixing roller 10 is rotationally driven in the direction indicated by an arrow mark by the driving force transmitted from an unshown mechanical power source to the fixing roller 10 by way of one end of the metallic core 11 of the fixing roller 10. As the driving force is transmitted, a film 33 is rotated by the rotation of the fixing roller 10, in the direction indicated by another arrow mark, around the stay/holder 32. A recording medium P is fed into an image forming apparatus as necessary, and is conveyed, following a heat resistant fixing apparatus entrance guide 15, into the fixing nip N formed by the fixing roller 10 and pressing member 30. After being discharged from the fixing nip N, the recording medium P is discharged into an unshown delivery tray by a sheet discharge roller 17 and a sheet discharge roller 18 while being guided by a heat resistant fixing apparatus exit guide 16.

Figure 10:
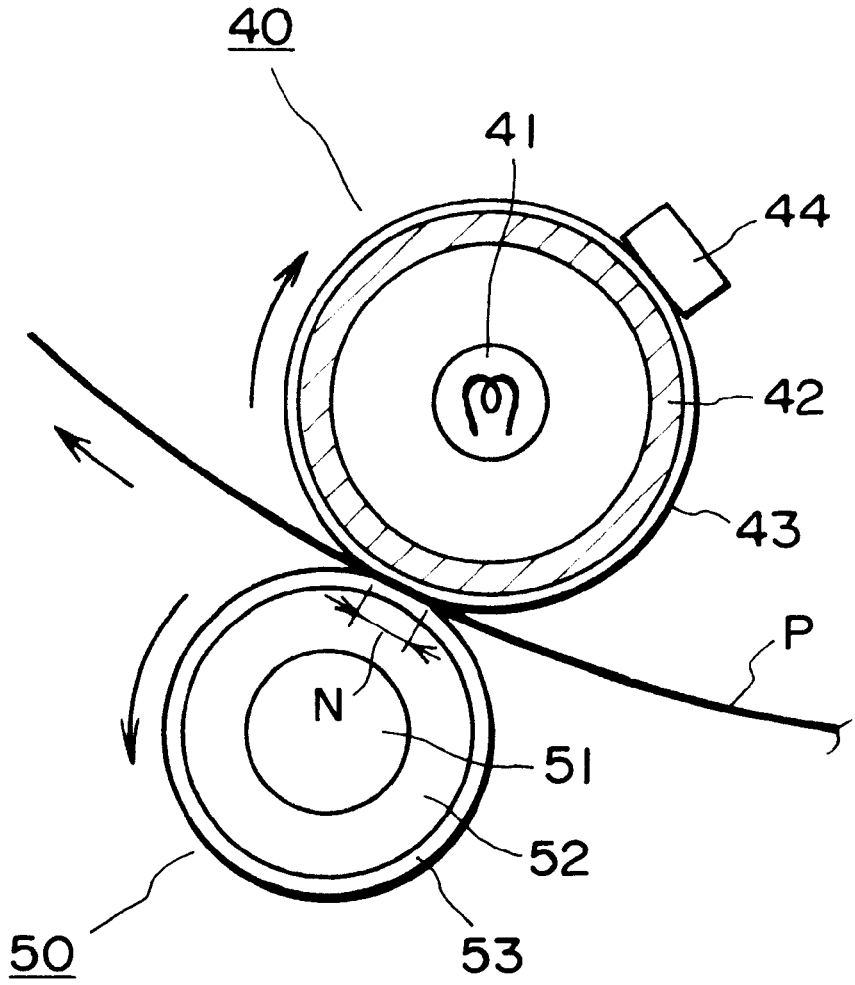
FIG. 10 is a sectional view of a heat roller type thermal fixing apparatus in accordance with the prior art.
Figure 11:
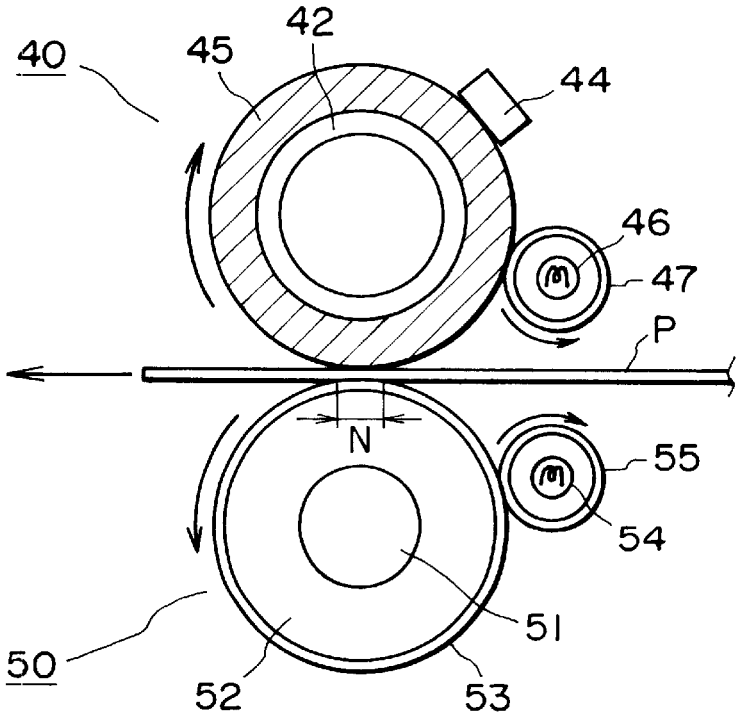
FIG. 11 is a sectional view of an example of a thermal heating apparatus in accordance with the prior art, in which the fixing roller is externally heated.

The above described thermal fixing apparatus was compared, in terms of the time it takes for the temperatures of the peripheral surfaces of their fixing rollers 10 to rise from the normal temperature of 25° C. to 200° C., to the thermal fixing apparatuses structured in accordance with the prior art. The results are given in Table 4, in which (1) represents thermal fixing apparatuses structured in accordance with this embodiment; (2) represents thermal fixing apparatuses in which a halogen lamp is disposed in the hollow of the fixing roller as shown in FIG. 10; (3) represents thermal fixing apparatuses which employs a heat roller comprising a metallic pipe, an electrically insulative layer placed on the internal surface of the metallic pipe, and a heat generating resistive layer placed on the electrically insulative layer; and (4) thermal fixing apparatuses which are identical in fixing roller and heating means to the thermal fixing apparatus shown in FIG. 13, but are different from the apparatus in FIG. 13 in that they employ, as a backing means, an elastic roller having a silicon rubber layer.

These four kinds of thermal fixing apparatuses were compared in terms of the time it takes for the temperatures of the peripheral surfaces of their fixing rollers 10 to rise from the normal temperature of 25° C. to 200° C. The amounts of the electrical power supplied to their heaters were all 1000 W. They were adjusted in the revolution of their fixing rollers 10 so that the speed (process speed) at which recording mediums were passed through them became 250 mm/sec.

TABLE 4

| Structures | Time for reaching 200° C. (sec) |
|---|---|
| (1) Embodiment | 7.0 |
| (2) Heating roller (halogen lamp) | 34.0 |
| (3) Heating roller (resistor) | 20.0 |
| (4) Elastic pressing roller | 15.0 |

The following are evident from Table 4: The thermal fixing apparatus structured in accordance with this embodiment were shorter in startup time, being therefore smaller in power consumption. The thermal fixing apparatuses (2) and (3), in which the entirety of the heat roller heated up, were longer in startup time. This is thought to be for the following reason: In the case of the systems in the thermal fixing apparatuses (2) and (3), a substantial amount of the generated heat radiates into the ambience, making the systems smaller in the amount of the heat given to a recording medium in the heating nip. Also in the case of the apparatuses employing, as a pressing means, a member, such as an elastic roller, which is larger in thermal capacity, the heat from the fixing roller accumulates in the pressing member, being therefore longer in startup time compared to the apparatuses structured in accordance with this embodiment shown in FIG. 13. Still, they are better in startup time than those in accordance with the prior art.

The difference in thermal efficiency affects how electrical power supply must be controlled while a recording medium is passed through the fixing nip N and during recording medium intervals in a continuous printing operation. In other words, as a recording medium is passed through the fixing nip N, the peripheral surface temperature of the fixing roller 10 decreases. Thus, it is necessary to raise the peripheral surface temperature of the fixing roller 10 after each passage of a recording medium. For this purpose, a structure such as that in accordance with this embodiment which is high in thermal efficiency is advantageous in that the reduced peripheral surface temperature of the fixing roller can be raised to the fixing temperature with a smaller amount of electrical power supply.

Figure 14:
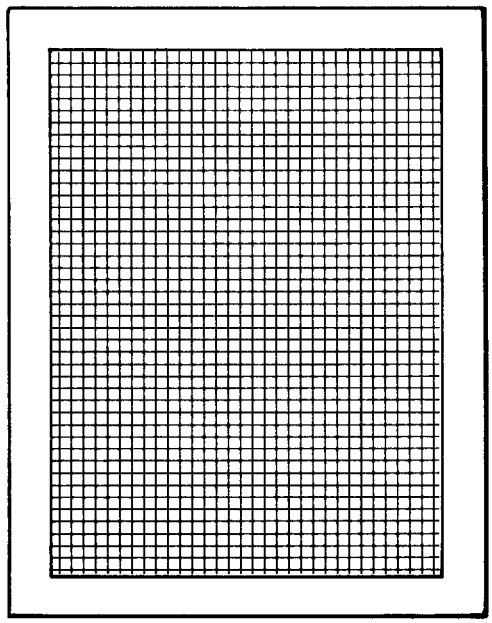
FIG. 14 is an image pattern used for fixation tests.

Further, not only is the structure in accordance with this embodiment superior in terms of process speed, but also in terms of image quality. The thermal fixing apparatus, shown in FIG. 12, which employs a film heating method, is superior in that it is shorter in startup time and smaller in electrical power consumption, displaying virtually the same performance. However, a thermal fixing device of a film heating type, in particular, a thermal fixing device in which the fixing film is moved by the rotation of the pressing roller, suffers from the problem that as its operational speed is increased, image quality is likely to become inferior. This is for the following reason: as its operational speed is increased, the speed at which the fixing film is moved by the rotation of the fixing roller tends to fall behind the peripheral speed of the pressure roller; and the surface of the fixing film is harder than the surface of the fixing roller having an elastic layer, making the fixing film inferior to the fixing roller, in terms of conformity to the toner and recording medium, and therefore, the heat transfer from the fixing film to the toner and recording medium is not as good as that from the fixing roller having the elastic layer to the toner and recording medium. The following is the results of the comparison between the thermal fixing apparatuses structured in accordance with this embodiment (FIG. 13), and the thermal fixing apparatuses employing a film heating fixing method (FIG. 13), in terms of the changes in image quality which occurred as the process speeds of both groups of thermal fixing were increased to the identical high speeds. Process speed was set at 250 mm/sec, and heater temperature was controlled so that the peripheral surface temperature of the fixing roller or the surface temperature of the fixing film 73 remained in the range of 190–220° C. The test image was a grid pattern drawn in fine lines as shown in FIG. 14. After the fixation of the grid pattern image, the image was rubbed with silbon paper or the like while applying a predetermined amount of pressure. Then, the conditions of the fine lines of the grid pattern were visually evaluated to determine the fastness (fixing performance) of the fine lines. The results are given in Table 5, in which G means that the fine lines were erased nowhere; F means that the fine lines were erased across a small number of areas; and NG means that the fine lines were erased across a large number of areas.

TABLE 5

| Surface temp. of fixing roller/film | Embodiment | Film heating type |
|---|---|---|
| 190° C. | F | NG |

G: Good,
F: Fair,
NG: No good.

It is evident from the results given in Table 5 that the thermal fixing apparatus in accordance with this embodiment is high enough in fixing performance for the fixing apparatus to be employed as a fixing apparatus for a printer having a high processing capacity per unit of time.

Further, in this embodiment, a slippery plate is provided for forming the fixing nip (conveying nip) N. However, the provision of a slippery plate is not mandatory. For example, instead of a slippery plate, a flat ceramic heater similar to the heater 21 may be provided, for the following reason: when cardboard, rough paper, that is, paper rough in surface texture, etc., are used as recording medium, the amount of the heat which recording medium receives from the fixing roller is insufficient to heat the back side of the recording medium as well as the front side, making it possible for fixation to be unsatisfactory. In such a case, therefore, it is preferable that a flat ceramic heater is disposed in place of the slippery plate so that heat is supplied to the recording medium from not only the front side but also the back side, in order to assure satisfactory fixing performance.

As described above, in this embodiment, the elastic roller is externally heated by the flat heater, and the slippery plate is employed as a backing means which forms the fixing nip in cooperation with the elastic roller, with the interposition of the highly thermally insulative film. With the provision of this structural arrangement, it is possible to provide a thermal fixing apparatus which is shorter in startup time, smaller in power consumption, and yet, capable of satisfactorily performing even during a high speed printing operation.

[Embodiment 6]

Figure 15:
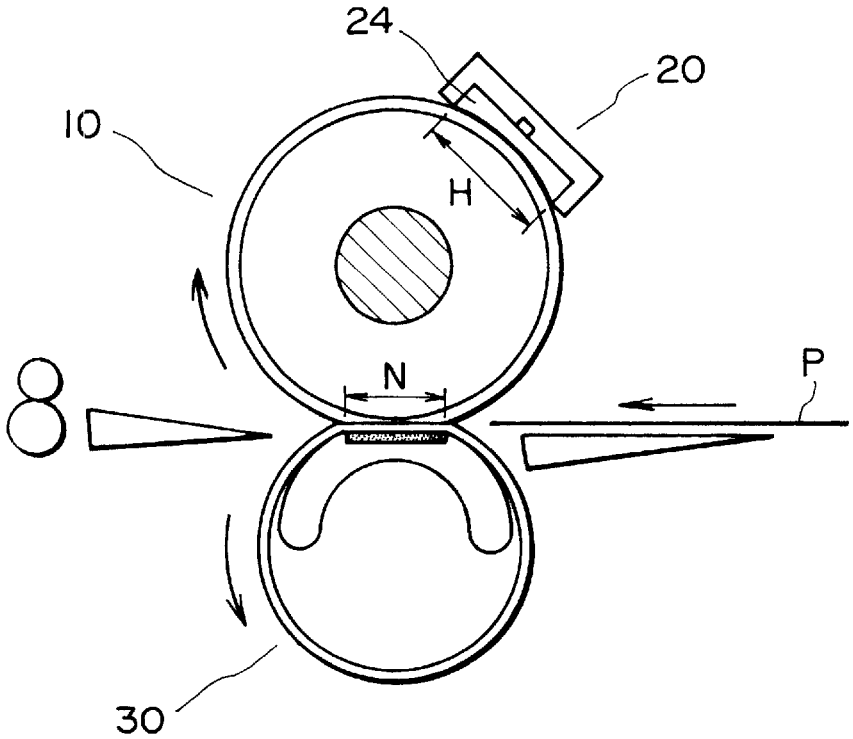
FIG. 15 is a sectional view of the image heating apparatus in the sixth embodiment of the present invention.

Next, the sixth embodiment of the present invention will be described. A thermal fixing apparatus in accordance with this embodiment is shown in FIG. 15. In FIG. 15, a heater 24 as a heating member comprises: a substrate, which is molded of ceramic such as aluminum, aluminum nitride, etc., and which is shaped so that its contour on the fixing roller side conforms to that of the peripheral surface of the fixing roller 10; and a heat generating resistive layer, the material for which is Ag/Pd (silver/palladium), $RuO_2$, $Ta_2N$, or the like, and which is painted on the substrate with the use of screen printing or the like. Since screen printing is used, it is preferable that the heat generating resistive layer is painted on the flat area of the back surface of the substrate instead of the arcuate inward surface. The thermally insulative stay/holder 22, etc., other than those described above are the same as those in the fifth embodiment. Therefore, they will not be described here.

In this embodiment, the contact pressure between the heater and the fixing roller 10 can be reduced by making the heater substrate arcuate on the side facing the fixing roller 10 as described above. In order to form the heating nip H, a predetermined amount of load must be placed on the fixing roller 10, and the applied load adds to the frictional resistance between the heater 21 and fixing roller 10 while the fixing roller is rotationally driven. Thus, when a flat heater such as the heater 21 in the fourth embodiment is employed, the frictional resistance between the heater 21 and fixing roller 10 is greater than when the heater 21 in this embodiment is employed. In other words, with the employment of the heater 21 in this embodiment, it is necessary to apply only a very small amount of pressure for the formation of the heating nip H, making it possible to reduce the torque for driving the fixing roller 10, compared to the fifth embodiment. The following Table 6 shows the difference, in the torque necessary to driving the fixing roller 10, between this embodiment and fifth embodiment.

TABLE 6

| Heater shape | Fixing roller driving torque |
|---|---|
| Flat (Emb. 5) | 5.0 kg · cm |
| Curved (This Emb.) | 2.3 kg · cm |

It is evident from Table 6 that this embodiment is smaller in the torque necessary for driving the fixing roller than the fifth embodiment.

Regarding the arcuation of the heater 24, the following is the range of the radius of the curvature of the heater 24 effective for reducing the torque for driving the fixing roller 10. If the radius R of the curvature of the peripheral surface of the fixing roller 10 is smaller than the radius r of the curvature of the arcuate portion of the heater 24, it is difficult to form a proper heating hip H. Therefore, it is desired that radius r is equal to, or greater than, the radius R. On the contrary, if the radius r is excessively large, the torque necessary to drive the fixing roller is not much different from that when a flat heater is employed. In this embodiment, the radius R of the curvature of the fixing roller 10 was 10 mm, and the radius of the curvature of the heater 24 used for comparison was also 10 mm. According to an experiment in which, in order to examine the effects of the relationship between the radius R and radius r, the radius r was gradually increased while keeping the width of the heating nip H constant, the torque necessary to drive the fixing roller 10 when the arcuate heater 24 was employed and that when a flat heater was employed became virtually the same when the value of radius r was 50 mm. Thus, the proper range for the radius r of the curvature of the heater 24 is: $R \leqq r \leqq 5R$.

When a flat heater such as the one in the fourth embodiment is employed, only method for increasing the amount of the heat supplied to the fixing roller is to widen the heating nip H by increasing the pressure applied to the fixing roller. This results in the increase in the torque necessary for driving the fixing roller. In comparison, when an arcuate heater, such as the one in this embodiment, which is made arcuate so that the contour of the heater conforms to that of the peripheral surface of the fixing roller 10, is employed, the pressure applied to the fixing roller does not need to be increased to widen the fixing nip H.

[Embodiment 7]

Figure 16:
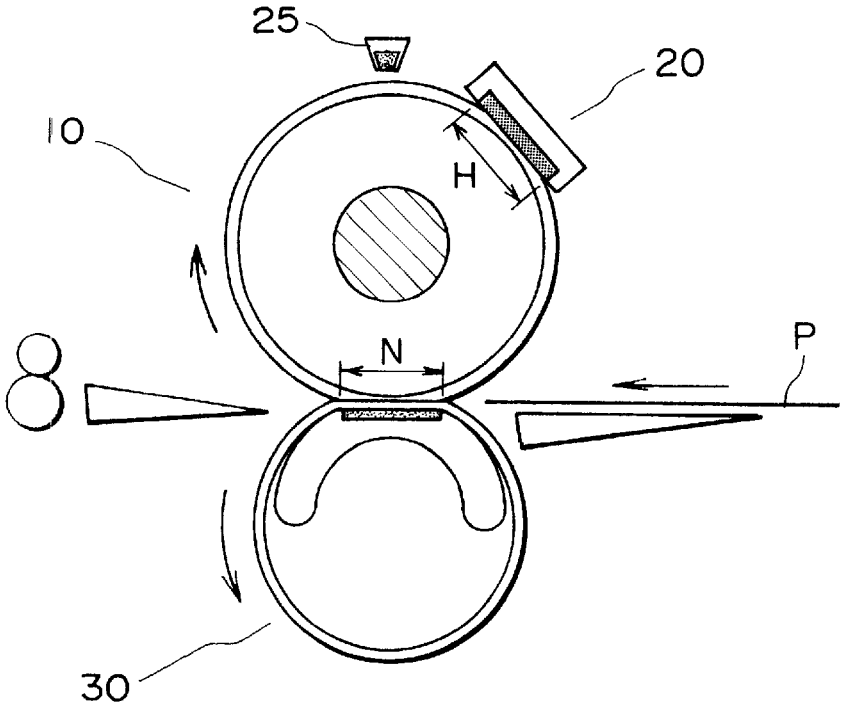
FIG. 16 is a sectional view of the image heating apparatus in the seventh embodiment of the present invention.

Next, the seventh embodiment of the present invention will be described. The structure of the thermal fixing apparatus in this embodiment is shown in FIG. 16. In FIG. 16, the differences of this embodiment from the fifth and sixth embodiments are that in this embodiment, the temperature detection element 25 used for controlling the temperature of the heater 21 is disposed in contact, or virtually in contact, with the peripheral surface of the fixing roller 10. For the prevention of the frictional wearing of the release layer 13, or the surface layer, of the fixing roller by the temperature detection element 25, the temperature detection element 25 is desired to be of a noncontact type. However, when the frictional wear is of no concern, the temperature detection element 25 may be of a contact type. For the purpose of making better use of the response of the temperature detection element 25, the temperature detection element 25 is desired to be placed on the upstream side of the heater 21, in terms of the rotational direction of the fixing roller 10, in particular, between the fixing nip N and heater 21. When the temperature detection element is disposed in contact with the heater as in the fourth embodiment, the drop in the surface temperature of the fixing roller 10 resulting from the recording medium passage is detected by the temperature detection element 23, after the portion of the fixing roller, the temperature of which has dropped, reaches the position of the heater. Therefore, before the temperature drop of the fixing roller is detected by the temperature detection element 23, the sum of the time it takes for the portion of the fixing roller, the temperature of which has dropped, to reach the position of the heater, and the time it takes for the temperature drop to affect the temperature detection element 23 through the heater substrate, elapses. In other words, it takes a substantial amount of time for the drop in the temperature of the peripheral surface of the fixing roller to be detected, in particular, when the substrate of the heater 21 is thick, or when the amount of the heat generated by the heater 21 is large. This delay in the temperature detection is not a desirable thing for the temperature control of the fixing nip N, and becomes a serious problem when attempting to increase the process speed of a thermal fixing apparatus. It is possible to control the amount of electrical power supply by estimating the amount of the temperature drop, based on the data obtained through experiments carried out in advance. However, the temperature drop is affected by recording medium properties and the temperature of the environment in which an image forming apparatus is being used, etc. Therefore, it is complicate to accurately control the fixing nip temperature based on the estimation. In comparison, with the temperature detection element 25 disposed on the upstream side of the heater 21, in terms of the rotational direction of the fixing roller 10, in particular, between the fixing nip N and heater 21, as in this embodiment, the drop in the temperature in the fixing nip N can be immediately detected. In other words, the temperature of the heater can be easily and accurately controlled by adjusting the amount of the electrical power supply to the heater in response to the amount of the temperature drop detected by the temperature detection element 25 in this embodiment, in order to keep the temperature of the fixing nip N within the proper range.

To describe more concretely, assuming that the surface temperature of the fixing roller 10 detected by the temperature detection element 25 immediately before a recording medium P enters the fixing nip N, that is, at the end of the standby period, is T1° C., and that as the recording medium enters the fixing nip N, the surface temperature of the fixing roller 10 drops by $\Delta T$ ° C., it is possible to increase the surface temperature of the fixing roller 10 back to T1° C. by supplying the heater 21 with heat, by the experimentally estimated amount necessary for compensating for the temperature drop of $\Delta T$ ° C. In this embodiment, the surface temperature of the fixing roller was adjusted by supplying the heater with electrical power by the amount equivalent to $\Delta T \times A$ watts.

Further, in this embodiment, the temperature detection element was placed on or next to only the surface of the fixing roller. However, it is possible to more precisely control a thermal fixing apparatus by placing a temperature detection element on or next to both the surfaces of the heater 21 and fixing rollers.

[Embodiment 8]

Figure 17:
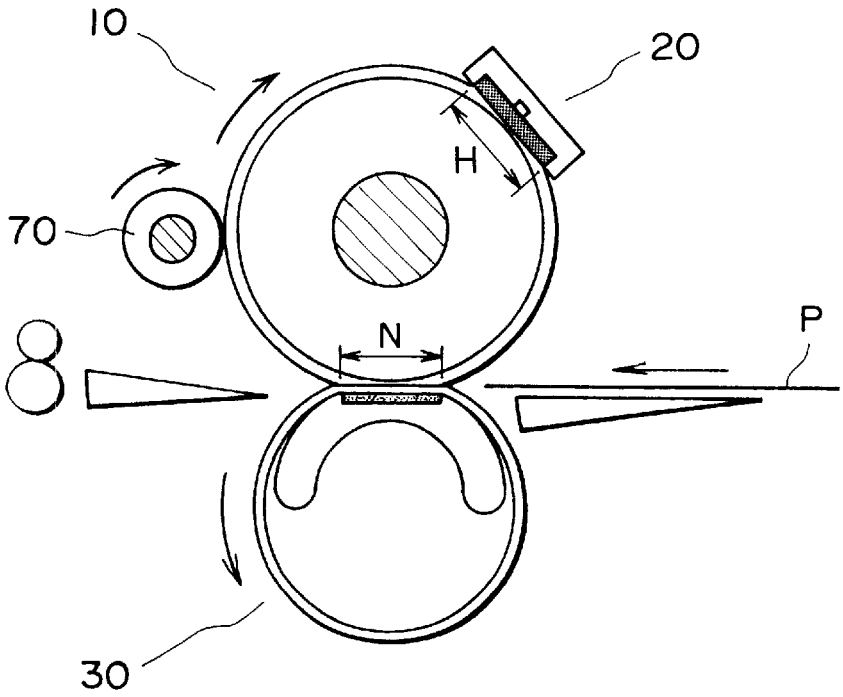
FIG. 17 is a sectional view of the image heating apparatus in the eighth embodiment of the present invention.

Next, the eighth embodiment of the present invention will be described. Referring to FIG. 17, a referential code 70 stands for an oil coating roller for coating oil on the fixing roller 10. Otherwise, the structure of the thermal fixing apparatus in this embodiment is the same as that in the fifth embodiment. Therefore, they will not be described here. The thermal fixing apparatus in this embodiment is set up so that oil is supplied to the surface of the oil coating roller 70 by an unshown oil supplying means. The material for the oil coating roller 70 may be web-like fabric such as felt so that the oil coating roller 70 can be soaked with oil, or may be elastic substance such as silicon rubber so that the surface of the oil coating roller 70 can be supplied with oil as necessary. The oil coating roller 70 is a part of a mechanism for uniformly coating the peripheral surface of the fixing roller with oil, and is rotated in the direction indicated by an arrow mark by the rotation of the fixing roller 10. The peripheral surface of the fixing roller is coated with oil for the following reason. The first is for reducing the frictional resistance between the heater 21 and fixing roller 10 by coating the peripheral surface of the fixing roller with oil. Without the coating of the fixing roller with oil, the amount of the torque necessary for driving the fixing roller 10 was approximately 5.0 kgf.cm. Further, the fixing roller 10 did not last as long as it did with the coating. For example, after the passage of approximately 10,000 recording mediums through the fixing nip, the release layer 13, or the surface layer, of the fixing roller 10 became separated from the main structure of the fixing roller 10, or the elastic layer 12 broke. On the contrary, as the fixing roller 10 was coated with oil, the amount of the torque necessary for driving the fixing roller 10 reduced to approximately 3.0 kgf.cm. Further, the fixing roller 10 lasted much longer; it did not break even when approximately 20,000 recording mediums were passed through the fixing nip. The second reason is for reducing the amount by which offset toner adheres to the fixing roller 10; coating the fixing roller 10 with oil is an effective means for fixing the unfixed color toner images on a recording medium to the recording medium, without triggering toner offset, with the use of a thermal fixing apparatus, in particular, such a fixing apparatus as the one in this embodiment. Without the provision of the oil coating roller, contaminants such as offset toner, etc., accumulate on the heater 21, in the adjacencies of its edge on the upstream side in terms of the rotational direction of the fixing roller 10. With the provision of the oil coating roller 70, however, not only is the amount by which the offset toner adheres to the fixing roller 10 reduced, but also the contaminants, such as the offset toner, remaining on the fixing roller can be removed by the oil coating roller 70.

However, as the amount of oil on the peripheral surface of the fixing roller 10 exceeds a certain value, the friction between the sliding film 33 and the fixing roller 10 becomes too small for the film to be rotated by the rotation of the fixing roller 10. Thus, the amount by which oil is coated on the peripheral surface of the fixing roller 10 must be kept at a predetermined value.

[Miscellanies]

1) In terms of the heater with which the heating ember 20 is provided, the application of the present invention is not limited to thermal fixing apparatuses, such as those in the preceding embodiments, the heater of which comprises basically a substrate formed of ceramic or the like and a heat generating resistive layer. For example, the present invention is also applicable to thermal fixing apparatuses which employ a heat generating element based on electromagnetic induction, or the like, as the heater for the heating member.

2) In terms of the pressing member 30, the application of the present invention does not need to be limited to thermal fixing apparatuses which comprises a pressing member employing a rotational film such as those in the preceding embodiments. For example, the present invention is also applicable to thermal fixing apparatuses comprising an elastic roller, or the like, as the pressing member.

3) In terms of the means for forming an unfixed toner image on a recording medium, the present invention is applicable to an electrophotographic image forming process, an electrostatic recording process, and the like image forming process, as well as a transfer type method, a direct method, etc. In other words, the image forming means is optional.

While the invention has been described with reference to the structures disclosed herein, it is not confined to the details set forth, and this application is intended to cover such modifications or changes as may come within the purposes of the improvements or the scope of the following claims.

What is claimed is:

1. An image heating apparatus comprising:

a rotatable member;

back-up means for cooperating with said rotatable member to form a feeding nip for feeding a recording material;

heating means for heating an outer peripheral surface of said rotatable member, said heating means including a heater in the form of a plate cooperable with said rotatable member to form a heating nip, wherein said back-up means includes a flexible rotatable member, and a slidable member disposed in said flexible rotatable member and cooperable with said rotatable member to sandwich said flexible rotatable member.

2. An apparatus according to claim 1, wherein said rotatable member has an elastic layer.

3. An apparatus according to claim 2, wherein said elastic layer is provided on an outer surface of a core metal.

4. An apparatus according to claim 2, wherein said elastic member is a porous material.

5. An apparatus according to claim 2, wherein hollow fillers are dispersed in said elastic layer.

6. An apparatus according to claim 2, wherein said rotatable member has a surface parting layer.

7. An apparatus according to claim 1, wherein said slidable member has a convex surface at a feeding nip side.

8. An apparatus according to claim 1, wherein said slidable member generates heat.

9. An apparatus according to claim 1, wherein said flexible rotatable-member has a thermal capacity which is smaller than that of said rotatable member.

10. An apparatus according to claim 1, further comprising a heat durable sheet sandwiched between said rotatable member and said heater.

11. An apparatus according to claim 10, wherein said sheet is movable.

12. An apparatus according to claim 11, wherein said sheet is movable in a direction in which an outer peripheral surface of said rotatable member moves.

13. An apparatus according to claim 11, wherein said sheet is at rest during said feeding nip feeds the recording material.

14. An apparatus according to claim 11, wherein said sheet has a thickness at a lateral end portion, which thickness is larger than that at the central portion.

15. An apparatus according to claim 11, wherein said sheet has a width, measured in a direction perpendicular to the movement direction thereof, is larger than a width of said rotatable member, measured in a direction perpendicular to a movement direction of said rotatable member.

16. An apparatus according to claim 10, wherein said sheet has a thickness of 5–25 microns.

17. An apparatus according to claim 10, wherein said apparatus is provided in an image forming apparatus to which a toner cartridge is detachably mountable, wherein said sheet moves in response to mounting and/or demounting of the toner cartridge.

18. An apparatus according to claim 10, wherein said apparatus is provided in an image forming apparatus to which a toner cartridge is detachably mountable, wherein said sheet moves in response to opening and/or closing of a cover for mounting and demounting the toner cartridge.

19. An apparatus according to claim 17 or 18, wherein said unit contains an image bearing member.

20. An apparatus according to claim 1, wherein said heater has a concave surface at said rotatable member side.

21. An apparatus according to claim 1, further comprising a temperature detecting element for detecting a temperature of said rotatable member, said temperature detecting element being disposed between said feeding nip and said heating nip downstream of said feeding nip with respect to a rotational direction of said rotatable member.

22. An apparatus according to claim 21, further comprising control means for controlling heat generation of said heater in accordance with an output of said temperature detecting element.

* * * * *

UNITED STATES PATENT AND TRADEMARK OFFICE

CERTIFICATE OF CORRECTION

PATENT NO. : 6,763,205 B2
DATED : July 13, 2004
INVENTOR(S) : Satoru Izawa et al.

It is certified that error appears in the above-identified patent and that said Letters Patent is hereby corrected as shown below:

Column 2,
Line 16, “the” should be deleted.

Column 3,
Line 65, “take” should read -- takes --.

Column 10,
Line 58, “is” should read -- is a --.

Column 12,
Line 65, “ratus” should read -- ratus. --.

Column 14,
Line 47, “to” should read -- to be --.

Column 15,
Line 4, “slide” should read -- slid --.

Column 16,
Line 38, “removal” should read -- removed --.

Column 25,
Line 7, “hip” should read -- nip --.

Column 28,
Line 42, “during” should read -- when --.

Signed and Sealed this

Twelfth Day of October, 2004

JON W. DUDAS
*Director of the United States Patent and Trademark Office*